US007725303B2

(12) United States Patent
Tramontana

(10) Patent No.: US 7,725,303 B2
(45) Date of Patent: May 25, 2010

(54) DEVICE AND METHOD FOR CHECKING RAILWAY LOGICAL SOFTWARE ENGINES FOR COMMANDING PLANTS, PARTICULARLY STATION PLANTS

(75) Inventor: Francesco Tramontana, Fossombrone (IT)

(73) Assignee: Alstom Ferroviaria S.p.A., Savigliano (IT)

( * ) Notice: Subject to any disclaimer, the term of this patent is extended or adjusted under 35 U.S.C. 154(b) by 1221 days.

(21) Appl. No.: 10/531,960

(22) PCT Filed: Oct. 16, 2003

(86) PCT No.: PCT/EP03/50724

§ 371 (c)(1),
(2), (4) Date: Nov. 15, 2005

(87) PCT Pub. No.: WO2004/044788

PCT Pub. Date: May 27, 2004

(65) Prior Publication Data

US 2006/0161416 A1 Jul. 20, 2006

(30) Foreign Application Priority Data

Nov. 14, 2002 (IT) ..... SV2002A0056

(51) Int. Cl.
*G06F 17/50* (2006.01)
*G06G 7/62* (2006.01)

(52) U.S. Cl. ..... 703/13; 703/6; 703/7

(58) Field of Classification Search ..... 703/6, 703/7, 13

See application file for complete search history.

(56) References Cited

U.S. PATENT DOCUMENTS

2002/0059050 A1* 5/2002 Hamadou et al. ..... 703/13

OTHER PUBLICATIONS

Donne et al. "Application of Modern Methods in Power Plant Simulation and Control", Computing and Control Engineering Journal Apr. 2001.*

* cited by examiner

*Primary Examiner*—Kamini S Shah
*Assistant Examiner*—Saif A Alhija
(74) *Attorney, Agent, or Firm*—Themis Law

(57) ABSTRACT

Method and device for checking logical software engines for commanding railway plants, particularly station plants, include at least a computer with at least a central processing unit and at least a memory for loading and executing programs, a logical engine for commanding a plant, particularly a station plant, being loaded or loadable in said memory for its execution, which plant comprises a plurality of operating units for actuating and/or detection and/or measurement and/or signalling, so-called wayside equipments, which units are provided for receiving command signals and for transmitting control signals about the operating condition, and which logical software engine reads control signals given by the operating units for actuating and/or detection and/or measurement and/or signalling and its processes command signals of said operating units based on an operation protocol of the plant itself. According to the invention, in the computer memory there is loaded or loadable and is executable by the computer a software simulation program of the plant that must be controlled and commanded by the control and command logical program, which simulation program reproduces faithfully the plant structure and the operating modes of the operating units provided in said plant.

53 Claims, 18 Drawing Sheets

* It is a cell value not inzialized. If the table includes "*" the simulator logic is not generated and associated to any variables.

X If this value is assigned to a cell, even all the cells on the right side will be "X" for that row. This means that the state identified by the corresponding row is not allowed. Practically it is a combination not allowed or not used during the simulation.

| TLD | CNT | TLD | CNT | PLS |
|---|---|---|---|---|
| 0 | 0 | 0 | 0 | 0 |
| 0 | 1 | 0 | 0 | 0 |
| 1 | 0 | 0 | 1 | 1 |
| 1 | 1 | 0 | 1 | 0 |

0 This means that, when the input conditions in this cycle are checked, the output in the next cycle will go at "0".

1 This means that, when the input conditions in this cycle are checked, the output in the next cycle will go at "1".

Fig. 10

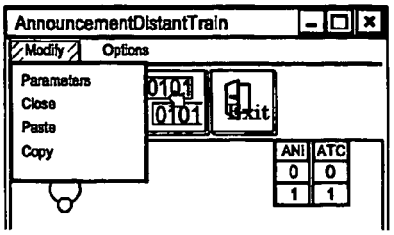

Fig. 11

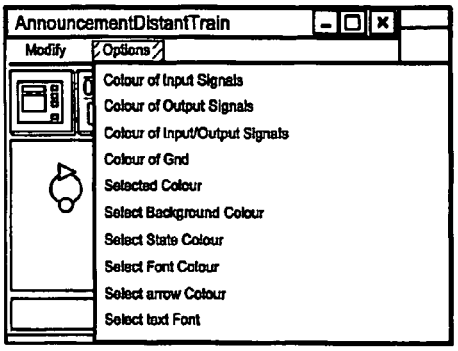

Fig. 12

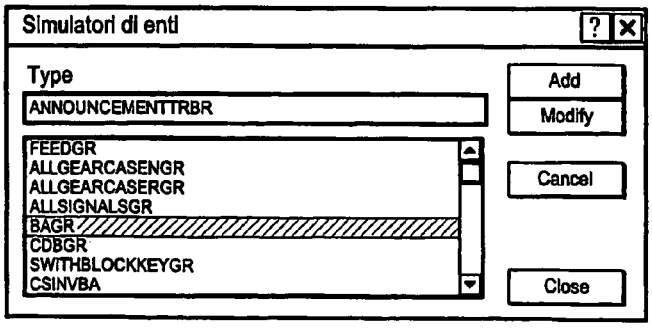

Fig. 13

| Condition Table | block_list |
|---|---|
| block_list | block<br>\| block_list block |
| block | block_head line_list |
| block_head | [ identifier ] |
| line_list | line<br>\| line_list line |
| line : | identifier = identifier_list |
| identifier_list : | identifier<br>\| identifier_list identifier |
| identifier : | [ A-Za-z0-9] |

```
(ASCV)
NAME = AREA
AREA _ TE = AREA 110AREA 371
CDB _ STAT = CB 129 CB 137 CB 130 CB 131 CB 132 CB 128
CDB _ LINE = CBL61 CBL59
DEV _ SEM = DV 107 DV 109 DV 110 DV 111 DV 112 DV 105
DEV _ COM = DV 103 DV 108
RAUT = DV 107 DV 109
SA = SA 141 SA 142 SA 143 SA 144 SA 145 SA 146 SA 147
SB = SB 103 SB 105 SB 104 SB 132 SB 131 SB 130
PTM = PTM 103 PTM 104 PTM 105 PTM 121 PTM 122
PT = PT 121 PT 141 PT 142 PT 143 PT 144 PT 145 PT 146 PT 147 PT 148 PT 149 PT 150 PT 151 PT 152 PT 122 PT 123 PT 124
PT 125 PT 126 PT 127 PT 128 PT 129 PT 130 PT 131 PT 132 PT 11 PT 10
RAR = RAR1
CNTR = 1_EPS_P SERV_N_ACS1_V
CMD_TO = COMM_N_ACS1 COMM_R_ACS1


(ROUTING)
NAME = IS 104_146
PTO = PTM 104
PTF = PTM 146
SBO = SB 104
SBF = SB 146
OPZ = IS 104_1461


(OPTION _IS)
NAME = IS 104_1461
DIR = RIGHT
ULT = CB 126
LIB = CB 104
CDB = CB 105
DEVS = DV 104 OPPOSITE DV 105 OPPOSITE
ZTE = AREA 110
SB = SB 126
INC_IS = IS 126_1021 IS 126_1111 IS 104_1451 IS 104_1441 IS 125_1021 IS 125_1111 IS 124_1021 IS 124_1111 IS 191_1261
INC_IT = IT 125_111 IT 124_111 IT 10_1451 IT 10_1441 IT 126_111 IT 10_1461
CDB_LIB = CB 105
CMD_TO = CMD 104_146
VAR_TF = IS 104_146
```

Fig. 19

ENCLOSURE PAGE A1
REPORT FILE EXECUTING TEST

```
proc Main { Istr }   {
   global Error

   global Name
   global codResult1
   global codResult2
   global Step
   global ProgrAcc

   global ListDevsd
   global ListDevc
   global CompleteListCdb

   global FlgRr

   set ls [string length $Istr]
   set FlgOpz [string first "_OPZ" $Istr]

   if { $FlgOpz > 0 }  {
   set ld [expr $ls - 5]
   } else {
   set ld [expr $ls - 2]
   }

   set IstrNoOpz [string range $Istr 0 $ld]

   # ---------------------------------- #
   #                                    #
   #    READING DATA BASE ROUTING       #
   #                                    #
   # ---------------------------------- #

   # Reading the name starting pto
   set Pto [ Read CFG CTDC 0 IST $IstrNoOpz PTO ]

   # Reading the name of ending point of the routing
   set Ptf [Read CFG CTDC 0 IST $IstrNoOpz PTF ]

   # Reading the name of SB of the starting point of the routing
   set Sbo [Read CFG CTDC 0 IST $IstrNoOpz SBO ]

   # Reading the name of SB of the ending point of the routing
   set Sbf [Read CFG CTDC 0 IST $IstrNoOpz SBF ]

   # Reading if the starting point of the rout. requires the cdb occupation
   # (~existing of 'train presence on cdb' )
   set LibPto [Read CFG CTDC 0 PTM $Pto CLEARING ]

   # Reading the simple switch blocks of the routing
   set ListDevs [Read CFG CTDC 0 IST $Istr DEVS ALL ]

   # Reading the switch blocks for communicating the routing
   set ListDevc [Read CFG CTDC 0 IST $Istr DEVC ALL ]

   # Reading buffer stops
   set ListSfc [Read CFG CTDC 0 IST $Istr SFC ALL ]

   # Creating list of cdb to be covered to execute the train transit
   set CompleteCdbList [ CreateCompleteCdbList $Istr ]

   set Area [ GetAreaIstr $Pto ]
```

ENCLOSURE PAGE A2
REPORT FILE EXECUTING TEST

```
set DataEqu [ ReadCFG CTDC C ASCV $Area DATA_
set DataTdc [ ReadCFG CTDC 0 ASCV $Area DATA_

if { [ llenght $DataEqu ] > 0 } {
     Message2 "Data Equations : $DataEqu"

if { [ llenght $DataTdc ] > 0 } {
     Message2 "Data tdc : $DataTdc"
     Message2 " "
}

# --------------- #
#                 #
#     STEP 1      #
#                 #
# --------------- #

### Blocking switch points in opposite position than the TDC
#
Message " Blocking switch points in clashing position than the TDC "
# Command levers in clashing position
PositionClashingList $Istr $ListDevs DEVS
# Command levers in clashing position
PositionClashingList $Istr $ListDevc DEVC
# Command in clashing position
#PositionClashingList $Istr $ListSfc SFC
#
###

set ProgrAcq 1
set FlgRr "F"
### Checking if switch points are at state : clashing FREE CONTROL
#
Message "Check switch points in state < clashing FREE CONTROL >"
# Checking clashing position
CheckPositionClashingList $Istr $ListDevs DEVS FREE CONTROL
CheckPositionClashingList $Istr $ListDevc DEVC FREE CONTROL
#CheckPositionClashingList $Istr $ListSfc SFC FREE CONTROL
#
###

Message "Commanding Routing $Istr"
if { $FlgOpz > 0 } {
    Command TF 0 IST $IstrNoOpz COMMAND OPZ
} else {
    Command TF 0 IST $IstrNoOpz COMMAND ""
}
# Check current state of the routing.
set Name $Istr
set codResult1 "1"
set codResult2 "2"
set Step 1
set ProgrAcq 1
set FlgRr "T"
CheckStateIstr REST TRUE RECORDED FALSE "" "" $Pto $Ptf

# Getting the name of the last switch point of the routing
set ListDevIstr [ concat $ListDevs $ListDevc $ListSfc ]
set NameLastDev [ lindex $ListDevistr [ expr [llenght $ListDevistr] - 1] ]

### Loop for all the switch points
#
set Step 2
set ProgrAcq 0
if { [ llength $ListDevs ] > 0 } {
    foreach NameDev $ListDevs {
        # Commanding switch point in central position (AUTOMATIC)
        Message "Commanding switch point $NameDev in AUTOMATIC position"
        Command TF 0 DEV $NameDev AUTOMATIC ""

        Message "Commanding Routing $Istr"
        if { $FlgOpz > 0 } {
            Command TF 0 IST $IstrNoOpz COMMAND OPZ
```

ENCLOSURE PAGE A3
REPORT FILE EXECUTING TEST

```
    } else {
        Command TF 0 IST $IstrNoOpz COMMAND ""
    }

    set ProgrAcq [expr $ProgrAcq + 1 ]
    if {$NameDev == $NameLastDev } {
        Message "Checking if the switch is in position < concordant BLOCKED CONTROL > "
        CheckSwitchPointState $Istr DEVS $NameDev CONCORDANT BLOCKED CONTROL
    } else {
        Message "Checking if the switch is in position < concordant FREE CONTROL > "
        CheckSwitchPointState $Istr DEVS $NameDev CONCORDANT FREE CONTROL
    }
    set ProgrAcq [expr $ProgrAcq + 1 ]
    Message "Checking routing state"
    # Check current routing state
    # Controlling if it is the last one
    if {$NameDev == $NameLastDev } {
        set codResult1 "3"
        set codResult2 "4"
        CheckIstrState PO_BLOCKED TRUE RECOREDED TRUE "" "" $Pto $Ptf
    } else {
        set codResult1 "1"
        set codResult2 "2"
        CheckIstrState REST TRUE RECOREDED FALSE "" "" $Pto $Ptf
    }
  }
}
set tmpDev "-"

if { [ llength $ListDevs ] > 0 } {
    foreach NameDev $ListDevc {
        if {$tmpDev = $NameDev } {
            # Commanding switch point in central position (AUTOMATIC)
            Message "Commanding switch point $NameDev in AUTOMATIC position"
            Command TF 0 DEV $NameDev AUTOMATIC ""

            Message "Commanding Routing $Istr"
            if { $FlgOpz > 0 } {
                Command TF 0 IST $IstrNoOpz COMMAND OPZ
            } else {
                Command TF 0 IST $IstrNoOpz COMMAND ""
            }
            set ProgrAcq [expr $ProgrAcq + 1 ]
            if {$NameDev == $NameLastDev } {
                Message "Checking if the switch is in position < concordant BLOCKED CONTROL > "
                CheckSwitchPointState $Istr DEVC $NameDev CONCORDANT BLOCKED CONTROL
            } else {
                Message "Checking if the switch is in position < concordant FREE CONTROL > "
                CheckSwitchPointState $Istr DEVC $NameDev CONCORDANT FREE CONTROL
            }
            set ProgrAcq [expr $ProgrAcq + 1 ]
            Message "Checking routing state"
            # Check current routing state
            # Controlling if it is the last one
            if {$NameDev == $NameLastDev } {
                set codResult1 "3"
                set codResult2 "4"
                CheckIstrState PO_BLOCKED TRUE RECOREDED TRUE "" "" $Pto $Ptf
            } else {
                set codResult1 "1"
                set codResult2 "2"
                CheckIstrState REST TRUE RECOREDED FALSE "" "" $Pto $Ptf
            }
            set tmpDev $NameDev
        }
  }
}
set codResult1 "10"
set ProgrAcq [expr $ProgrAcq + 1 ]
```

ENCLOSURE PAGE A4
REPORT FILE EXECUTING TEST

```
### Checking low signal state starting point
#
Message" Checking low signal state starting point "
if { [ check DAS 0 SB $Sbo FREEROUTE TRUE 3 0 ] == "TRUE" } {
   Message " CHECK OK : The low signal $Sbo is FREE TRANSIT"
   PrintRealRisults $Name $Sbo $codResult1 $Step $ProgrAcq
} else {
   set error "1"
   Message " CHECK FAILED " : The low state $Sbo is not FREE TRANSIT"
   if { $FlgRr == "T" } {
      set ECodResult "E"
      append ECodResult $codResult1
      PrintRealRisults $Name $Sbo $codResult $Step $ProgrAcq
   }
}
#

# --------------- #
#                 #
#     STEP 2      #
#                 #
# --------------- #
```

DEVICE AND METHOD FOR CHECKING RAILWAY LOGICAL SOFTWARE ENGINES FOR COMMANDING PLANTS, PARTICULARLY STATION PLANTS

BACKGROUND OF THE INVENTION

1. Field of the Invention

The invention relates to a device for checking logical software engines for commanding railway plants, particularly station plants, comprising at least a computer with at least a central processing unit and at least a memory for loading and executing programs:

a logical engine for commanding a plant, particularly a station plant, being loaded or loadable in said memory for its execution, which plant comprises a plurality of operating units for actuating and/or detection and/or measurement and/or signalling, so-called wayside equipments, which units are provided for receiving command signals and for transmitting control signals about the operating condition, and which logical software engine reads control signals given by the operating units for actuating and/or detection and/or measurement and/or signalling and it processes command signals of said operating units basing on an operation protocol of the plant itself.

2. Description of Related Art

In railway field, the command of station plants occurs by means of command logical engines which are based on Boolean algorithms. Control and command signals are univocally associated to state variables which are processed by Boolean logic that provides output command signals as modifications of said Boolean variables. Depending on the features of provided operating units, each of the said variables may have various state conditions and the associated variables representing the state controls and the state commutation commands of operating units may vary within predetermined values, each of the said values represents an operating condition of the operating unit as far as variables representing control signals are concerned, while the said values represent a commutation command from a predetermined operating condition to a different predetermined operating condition or a command for maintaining the operating condition as far as command signals are concerned.

Starting from a traditional realization of command and control logics, particularly of railway plants, in the shape of relay networks, at present the greater reliability and stability, as well as the greater comfort and flexibility in using computers, have caused the transfer of command functions from the relay hardware structure to a software command system emulating the behaviour of the traditional relay network by means of a command and control logical program composed of Boolean algorithms.

Because of the complexity of railway plants, even the logic for controlling and commanding the plant is relatively complex specially considering that in railway field the security operation standards are very high.

In order to transform the control and command hardware logic formed by relay networks into a program in the form of a control and command Boolean engine, hardware/software smart systems have been developed to process automatically the control and command Boolean program by starting from a traditional relay hardware network layout or from a table wherein the operation conditions of the plant are encoded in the shape of lists of state variables and state commutation variables, the so-called condition table.

At present the validation, i.e. tests, are directly made on the plant. However, this is a serious drawback firstly because an operating plant is actually required to which the control and command logic has to be applied. This causes great problems due to great prolongation of time for definitive installing a railway plant, since in addition to time for actual structural installation, such as line laying, and the hardware installation of operating units, it is necessary to make long validation phases of the command logic thereof.

To solve this problem, at least partially, software programs for validating command software logics have been provided, i.e. Boolean engines for controlling and commanding the station plants, that process individually and in parallel the same command and control logical engine by means of at least two generation programs of the control and command logical engine, starting from the same basic information about the system structure and the operation modes thereof. Two command and control logical engines are therefore generated and are therefore compared, whereas the validation is based on diversity criterions of the programs generating the two logical engines which are considered correct in case of functional identity basing on said diversity of the two generating programs.

Such validation or certification mode does not meet fully considerations that are made from the security perspective of the plant operation and so the control and command logical program that has been obtained is always subjected to a deep validation directly on the plant. The certification or validation mode by means of the diversity criterion of the software generating the command and control logical program lacks an interface with the plant.

Therefore, even in this case of software certification and validation, such defect influences again the time for fabricating the plant in operation condition and the time for developing and setting up both the control and command logic and the plant itself. The situation becomes more serious considering not only the installation of a new plant, but also the modification of an existing plant. In such case certifications and validations made on field influence railway traffic that pass anyway and must continue to pass on railway lines already existing. Therefore times are smaller and working conditions are more critical both for the difficulty in working on a plant in use and for the considerations about traffic security that cannot be interrupted except for short periods.

Therefore, the purpose of the invention is to provide a device as described hereinbefore that overcomes the drawbacks existing at present and described above.

BRIEF SUMMARY OF THE INVENTION

The invention attains the above purposes by means of a device as described hereinbefore, wherein a software simulation program of the plant is loaded or loadable in the computer memory and is executable by the computer itself, which simulation program must be controlled and commanded by the control and command logical program and which simulation program faithfully reproduces the plant structure and the operating modes of operating units provided into said plant.

The simulation of the plant structure and of the operating units associated thereto, such as track circuits to detect the presence of the train, switch points actuators, signalling actuators and other different units is represented in the simulation program by Boolean algorithms, variables associated to said algorithms being univocally defined to represent control signals of the several state or operation conditions of various operating units and the command signals for commutating or maintaining state or operating conditions of said various operating units.

In a first embodiment the image of the plant behaviour under examination of the control and command logical program is displayed in the shape of variable lists univocally associated to the several operating units. In such case, the program displays or enables the display of report files wherein the several operating units and the associated state or command variables are listed.

Advantageously, the simulation program allows the user to set starting operating conditions of the plant and/or setting situations even anomalous of the plant operating units to verify the plant reaction to these conditions.

According to a preferred embodiment, to each plant operating unit and/or to each relevant structural element can be associated univocally a virtual image of the operating unit and/or of plant structural element, which image is generated by means of a graphic program loaded, loadable and/or executable by the computer of the device according to the invention. The virtual image is univocally correlated to the logical program for generating the operating unit or the plant structural element, the graphic program for generating the virtual image of each operating unit being such to generate various graphic aspect conditions of the operating unit, each of them is univocally correlated to a predetermined value of variables relevant to the operating condition of the operating unit itself and/or of command variables for commuting or maintaining the operating state of the operating unit.

According to a further aspect of the invention, the operation of the control and command logical program is additionally in parallel or alternatively represented in the shape of behaviour of the equivalent command hardware logic composed of a relay network, an operation simulation program of relays and an operation simulation program of the relay network being provided, as well as graphic programs representing relays univocally associated to each program for simulating relays and to program for graphically displaying the relay network.

Also in this case, as in the case of operating units, each relay is simulated by means of a logical program of the Boolean type, single state conditions of the relay and/or the commutation commands being represented by state or command variables and graphic programs being such to associate various relay graphic aspects univocally correlated to values taken by said state or command variables.

By means of what said before, the device according to the invention enables the execution of the validation or the certification of the control and command logical program of the system on the base of a true and reliable software model of the real plant with evident advantages in relation to certification and validation systems used at present.

The two levels for displaying the functional behaviour of the plant, in the shape of report file displaying values of state variables generated by programs processed by simulation logical programs of operating units and in the shape of graphic representation of the operating condition of operating units allow to check in details the operating units of the plant and therefore the operation modes thereof both in an analytic way and in a direct visual way of the physical operation condition.

A further alternative allowing the display of the command and control logical engine in the shape of traditional relay network allows to check the engine operation according to the traditional hardware logic providing an additional visual check means. However, also in this case it is possible to display physically the aspect modifications of relays relevant to the operating condition, as well as to display analytically the state and command variables analogously to what said for the operating units. It will be noted that the graphic representation of the Boolean command and control logic, in the shape of traditional relay network, allows to check visually the internal operation of said logic, therefore making simpler the identification of errors inside the logic itself and not only on the base of wrong commands sent to operating units. Therefore it is displayed not only the situation of output variables and input variables to the control and command logic engine, but also the situation of modifications to which said variables are subjected during the processing from input to output.

Additionally, the provision of an interface for setting particular operating conditions of the plant or anomalous conditions enables the verification of the plant reactions with reference to different operating environment. Such settings can be executed by the personnel by imposing specific state conditions to various operating units at the beginning of the execution cycle of the control and command logical engine, being possible, by means of a suitable scheduling, to provide also conditions wherein one or more operating units are non-operating or operating in an anomalous way.

It is easy to notice that in the case of the present invention it is possible to program or configure images and/or state and command variable lists of virtual operating units corresponding to the desired or proper operation or state condition of the plant in conjunction with a predetermined operation situation. In such case, by providing such nominal graphic images and such nominal values of state and command variables of virtual operating units it is possible to make not only the direct and visual verification of a proper operation but also an automatic verification based on the comparison between the nominal image and the table or the nominal list of state and command variables desired and previously scheduled and the image and the state and command variables effectively processed in the moment of operation of the control and command logic with the virtual model of railway plant, an error message being sent in case of non-identity. During this automatic verification can be displayed graphically and analytically the operating unit that assumed a wrong condition and the relative state or command variable/variables.

Such mode can be extended also to the simulating representation of relay network, indicating the relay or relays that have not been commutated in the right condition and the relative state or commutation command variables.

As a further development it is also possible to provide automatic means that correct the control and command logical program on the base of possible corrections made by the user to the state or command variables modified manually in the presence of a state or command error of a virtual operating unit or of a relay in the corresponding command logical circuit constituted of the virtual model of relay network.

In this case, modification interventions both of alphanumeric type made on report files of state or command variables, or interventions for modifying graphically the aspect of the operating unit or relay corresponding to the state of said operating unit or said relay are interpreted by a correction program that analyse the values of state or command variables set manually to correct wrong values, analyse the control and command logical program and modify the code to commute the operating unit or the relay in the correct state condition when occurs the operation condition with which the control and command logical program had previously generated the error.

It is also possible to memorize areas of the virtual station plant and the relative parts of the control and command logical program having typical plant structures that are recurrent in various station plants, to load and reuse both programs of Boolean simulation, and graphic display programs as well as parts of control and command logical programs in new station plants having identical station areas.

The hardware/software structure of the device according to the invention allows to extend the validation and the certification even to a validation and certification system based on the diversity of the program for generating the control and command logical program, for example a so-called Boolean algorithm checker.

It is possible to provide several possibilities. A first of these possibilities is to provide an additional program for generating the control and command logical program object of validation by the device that works according to a code different than that used for generating the control and command logical program during the validation. The control and command logical program generated by the checker may be compared with the control and command logical program during the validation to notice the identity between the two control and command logical programs. In addition or alternatively the control and command logical program generated by the checker may be subjected to the certification or validation by means of the device described above and the results may be compared to those obtained during the validation or certification of the first control and command logical program. In this case the comparison verification is made on state and command variables of operating units and relays of the relay virtual network both from a numeric perspective and from a graphic perspective. For example a overlapping of graphic images of the plant state conditions may be supposed which are obtained with the two control and command logical programs. With this overlapping of the image of plant state condition the possible differences are graphically highlighted or catch directly the user eye.

The two modes described above may be made alternatively or successively one with respect to the other, the modification of the succession sequence of the two different comparison modes being also possible.

By making first the comparison relevant to the plant conditions obtained by the two control and command logical programs it is possible for example to identify better the parts of the program wherein the comparison operations and so the possible correction operations thereof or the debugging enquires (error detection) may be limited.

It is possible to make the certification based on diversity in addition to the control logical program even to the logical programs for simulating the single operating units and the plant structure as well as to logical programs for simulating relays or the relay network and in case this certification action based on the diversity of the generating program may be extended also to programs for graphically representing operating units or relays.

In a further embodiment, the Boolean checker is composed of a parallel device for verifying the control and command logical program of the railway plant by simulating the plant itself, which checker comprises a check or test program and the simulation programs of the railway plant developed according to diversity criterions, i.e. by other generating or writing programs and such checker makes the same certification of the device according to the invention, that is the first checker device, on the same control and command logical program, the results of the two parallel tests being compared and from this comparison information or error messages are generated depending on the result of the test if it is equal or if it has diversities.

In the field of the device according to the invention a design program is included, i.e. for generating the Boolean code and the program for graphically representing the wayside equipments.

While the device of the present invention is based on traditional or substantially traditional processing systems, it should be noticed that actually it is a technical device constituting substantially a virtual simulator of the real plant structure and so it has advantages and technical effects.

The choice of software means is based on the fact that the command logic is software as well, whereby the implementation by means of a software means is the best solution.

It should be noticed also that the device according to the present invention may be provided with a suitable network interface and it may become a non-vital node of the railway plant by means of which it is possible to modify easily the command and control logical program and to overcome virtually the same, for example in the case of a structural modification of the station railway plant, such as the removal of a line or the addition of a line with the corresponding operating units.

Moreover the device according to the invention as a node network connected and interfaced with the railway plant may have supervisory or diagnostic functions of the correct operation of the real railway plant, because it is easy to make a comparison between the state condition that has been assumed by the real plant and the one assumed by the simulated plant by providing the device with the same input variables of the real plant for the control and command logic. Such comparison may be made analogously to the comparison of the plant conditions obtained with the two control and command programs as described before for the additional validation or certification based on diversity criterions.

By means of the device according to the invention, since it is a node that is part of a control and command system of a station plant, it is possible for example, in emergency event, to simulate various possibilities for intervening and commanding the plant to realize, on the plant itself, the choice that offers the best solution among the possible choices.

Advantageously the device according to the invention comprise a program for executing the simulating functions with a user interface of the type used by Windows® program of Microsoft Inc. and that therefore comprises operating windows with function buttons, quick choice menus and other functionalities typical of said interface, in addition obviously to the use of mouse or of other pointing means, to selection and input of commands and the keyboard to input numerical, alphanumerical data and/or numerical or alphanumerical commands, such as to create and modify the graphic images of operating units and/or of relays or of other parts of the plant structure. This makes the actions very simple and easy for the employed personnel by creating an interface between the computer and the program and the user that is well known and of large employment.

Further features and improvements of the device according to the invention are subject matter of the dependent claims.

BRIEF DESCRIPTION OF THE SEVERAL VIEWS OF THE DRAWINGS

The features of the invention and the advantages derived therefrom will appear more clearly from the following detailed description of some embodiments by way of a non-limiting example illustrated in the annexed drawings, in which:

FIG. 10 shows a table for describing values that can be assumed by variables in truth table and the above table.

FIG. 11 and FIG. 12 show drop down menus that can be activated by the specification window of the behaviour of the operating unit or of wayside equipment according to FIG. 10 to execute particular specification functions of said behaviour.

FIG. 13 shows an example of a window for selecting graphic aggregates.

FIG. 19 shows an example of "Condition table" file.

The annexed pages A1, A2, A3, A4 show an example of a test according to the tool for executing automatic test and include the report file of said test.

DETAILED DESCRIPTION OF THE INVENTION

Figure 1:
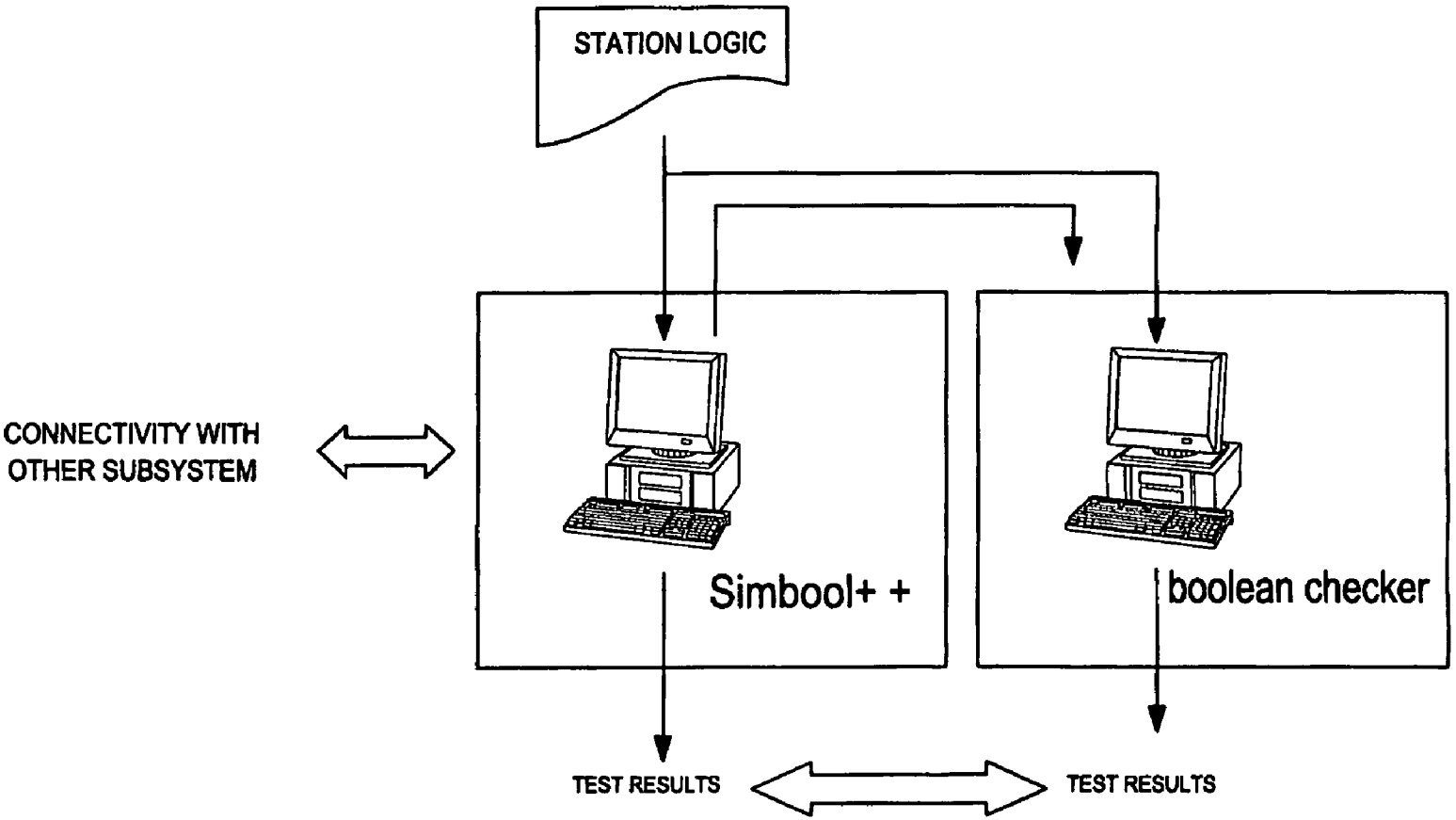
FIG. 1 schematically shows a device according to the invention in the shape of a computer or a personal computer and the possible remote connections.

Referring to FIG. 1, the device according to the invention consists of a function simulator of one or more systems that are composed of a station apparatus with a vital computer with regard to test of the command and control application logical program which is implemented as a group of Boolean equations. The device is formed as to simulate a station apparatus with a vital computer in all its operating conditions.

In traditional systems for commanding and controlling railway plants, the application logic for operating the system is in the shape of a relay network. Lately, with introduction of computers more and more reliable and steady, application logic of the plant has been replaced by a command and control logical program which is executed by a computer. The program is comprised of a group of Boolean equations that cyclically read the state conditions of a plurality of operating units, the so-called wayside equipment, such as track circuits for detecting the presence of trains at predetermined line lockings, signalling devices, switch points, etc., and basing on said conditions, coded in the shape of state variables, the Boolean equations compute or define new output state variables that constitute commands for commuting the state or for maintaining the operating state of operating units for the adjustment to conditions represented by the input variables.

The group of Boolean equations has to execute the computation of the state conditions of wayside equipments in a way corresponding to predetermined operation modes that are coded in functional behaviour tables of the plant, so-called condition tables. The device according to the present invention has to emulate the functional behaviour of a railway plant, that is a vital computer railway apparatus. Such emulation enables the verification of the control and command logical program expressed by the formalism of the Boolean equation system as if the verification is executed on the real plant itself. And this occurs both when the plant is in correctly operating conditions and when there are anomalies of one or more wayside equipment.

Figure 2:
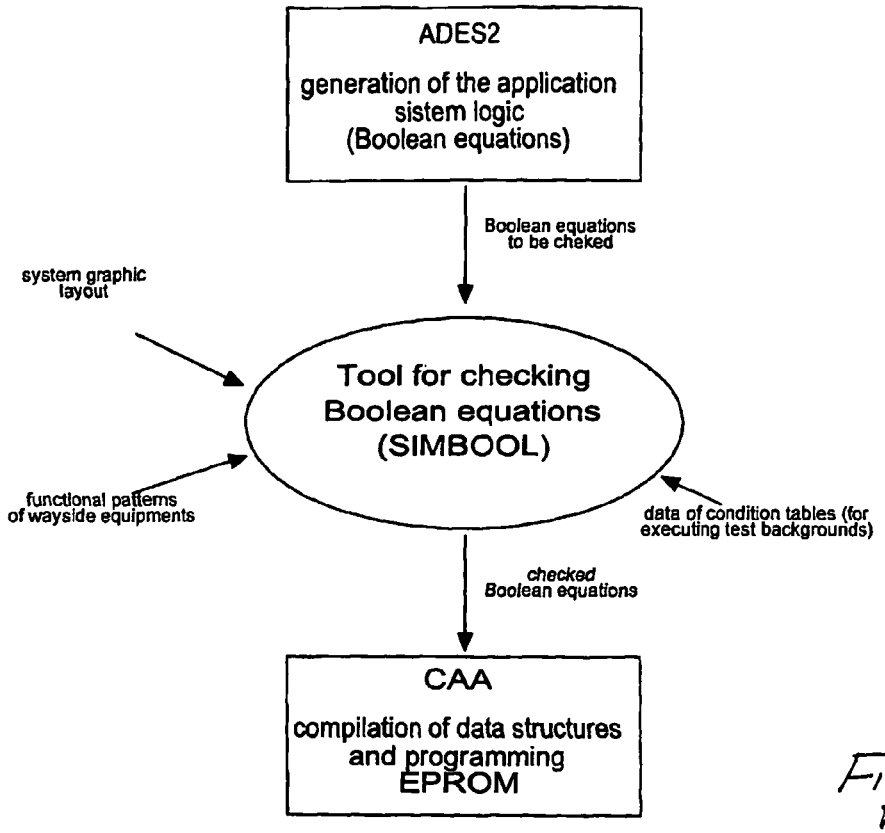
FIG. 2 shows a flux diagram of the functional test made by the device according to the invention.

The device according to the present invention as shown in FIG. 2 includes a computer memorizing a test and simulation program and has interfaces to data and/or commands inputting means, display means, connecting means to remote apparatus, such as the station apparatus with vital computer, remote computers for executing collateral procedures and so on. The emulation program includes several routines and in particular:

a routine to execute the Boolean equations that composed the program itself;

a routine to configurate input or initialization variables of Boolean equation system, that is the setting of operation backgrounds of the plant;

a routine to display the graphic image of the plant and of operating units included therein and which provide an image of operating units that is different for each of the operating states that can be assumed by the operating units or wayside equipment and which graphic image is univocally connected to said state or said operating condition of the wayside equipment, as well as to other collateral routines that complete and simplify test actions.

The plant simulation occurs by generating a virtual model of station plant wherein the operating and/or structural elements of the plant are univocally identified and whose functional behaviour is restored by Boolean equations.

The physical structure of the system is defined by associations of said structural or operating units that describe and/or display the respective arrangement in the plant diagram and define which operating units have to work together.

As it will be noticed more clearly below, the operating units, i.e. wayside equipments, are described by output state variables so-called control and that describe the operating condition of the unit or wayside equipment and by variables for maintaining and/or modifying the input state that indicate if the operating unit has to change state or not and towards which state the transition has to occur.

To generate the virtual model of the railway plant, the device according to the present invention provides not only the simulation of the functional behaviour of wayside equipments in the shape of logical program in the form of Boolean equations, but also the graphic representation of the wayside equipment. Such graphic representation comprises several predetermined graphic aspect options of the wayside equipment, each of them corresponds univocally to an operating state thereof and is associated to one of the predetermined values that are assumed by the state variables of the simulation logical program of the wayside equipment or to a predetermined value combination of two or more state variables provided by the simulation logical program of wayside equipment. Obviously, the graphic aspects of the wayside equipment will be schematic reproductions of the wayside equipment aspect and the several aspects corresponding to the several operating conditions of each equipment are different one from the other so as to reproduce as much as possible the real modifications of the aspect of wayside equipment in various operating conditions.

Advantageously the device according to the invention may also comprise tools for modifying and/or generating simulation logical programs of wayside equipments and/or of the graphic aspect for representing said equipments in various operating conditions. These can be memorized and then recalled as generic routines that assume a specific and unique role in a predetermined plant diagram by means of defining univocal identification names and univocal relations or functional associations with other wayside equipments or other structural elements of the plant as well as with corresponding arrangement relations in the space regarding the placing thereof in the graphic representation of the plant.

Obviously, as results from FIG. 1 the plant can operate also in direct combination with units generating the control and command logical program and/or with the real vital computer station apparatus and the real railway plant, being a non-vital node of a connection network with said units.

Figure 3:
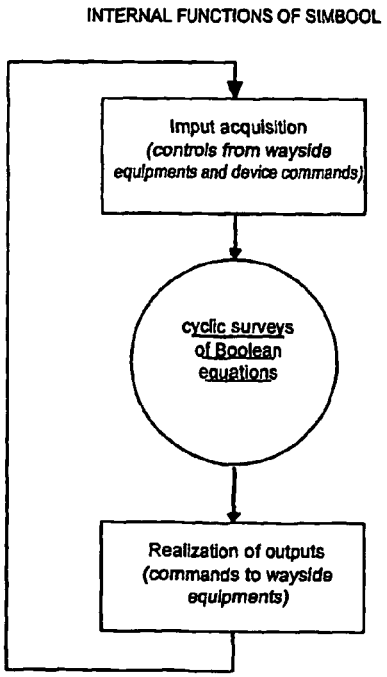
FIG. 3 shows a schematic diagram of the internal functions of the device according to the invention.

Therefore, referring to FIG. 3, the device substantially is a workstation based on a personal computer. Advantageously the preferred operating environment is Windows NT® environment upon which the specific device simulating software is set up. Said choice of the operating environment is an advantage as Windows NT® environment and its basic functionalities are broadly known. Therefore the operating environment is structured as to display several work windows, comprising the station or plant diagram, while the user is working on configuration and/or control elements of the simulation device itself. By means of one monitor and preferably two monitors the user can see directly the selected functions or set actions, as the main simulation logical program and the graphic management program interact therebetween.

The auxiliary display is controlled by the desktop extension functions already provided in Windows® environment.

The software of the device is made as a typical Windows® application and therefore it employs typical tools of the operating environment. Here the specific sphere of all the possibilities and of the window structure of Windows® is not considered since this is part of a basic common and widespread knowledge.

To execute the checking by means of simulation with the device according to the invention it is necessary to make several starting activities comprising the following steps:

generating the graphic descriptive file for check means;

checking said graphic file;

generating Boolean equations whose system is the core of the control and command logical program;

possible generating of the conversion table;

possible generating of the coded condition table;

possible generating of text files so-called batch commands.

The checking activity of the command logical program uses check means that are generally known.

The check program by means of railway plant simulation comprises the following data:

File with Boolean equations that describe a station or an area to be checked;

Graphic files of the station or station or area o areas to be simulated;

Possible files containing the conversion table;

Possible files containing condition table and possible text files containing batch files.

As the result of test is provided an output report file that can be used by the user and/or memorized. During the test execution, the dynamic operation of the railway plant may be controlled both real-time and in case later and this by means of the display of alphanumeric messages or of state variable values and by means of the graphic representation of the plant itself.

The starting of the working session may comprise the generation of a new project or the loading of projects already started. If it is a new project one or more stations or plant areas have to be selected to use in the simulation.

After the loading and/or the generation of the project data it is necessary to provide the device configuration. The activities to be executed to make the test by means of railway plant simulation are: setting of a system cycle time; definition of suffixes for each kind of wayside equipment, definition of simulators of wayside equipments, the possible addition of area to be controlled, association of equipment simulators to variables; definition of colours and states that the drawing objects can assume, assignment of stats and colours to the drawing objects.

As already said, there is also a command that operates directly on the graphic diagram of the station or of the plant area to define equipment states and objects colours.

It is possible to activate control windows by selecting windows or objects to be inserted in windows and/or to activate the command bar if it is not already active. Obviously it is possible to make tests and save the current state of the project. To this end, it is convenient to make savings as the simulation situation evolves, saving always with different names to not overwrite the old configuration. Each configuration is reloadable to start a new simulating step. During the simulation it is possible to execute configuration batch files corresponding for instance to different operation or configuration background of the plant or to different commands.

The device can be completely managed by a remote workstation by means of a command and remote connection module, particularly by means of network protocol and more preferably by means of TCP/IP protocol.

The user may end the check process by simulation at any time without loosing the work already carried out, by saving the project. Project means all files generated before the test process and all files generated during the configuration and simulation steps thereof.

Figure 4:
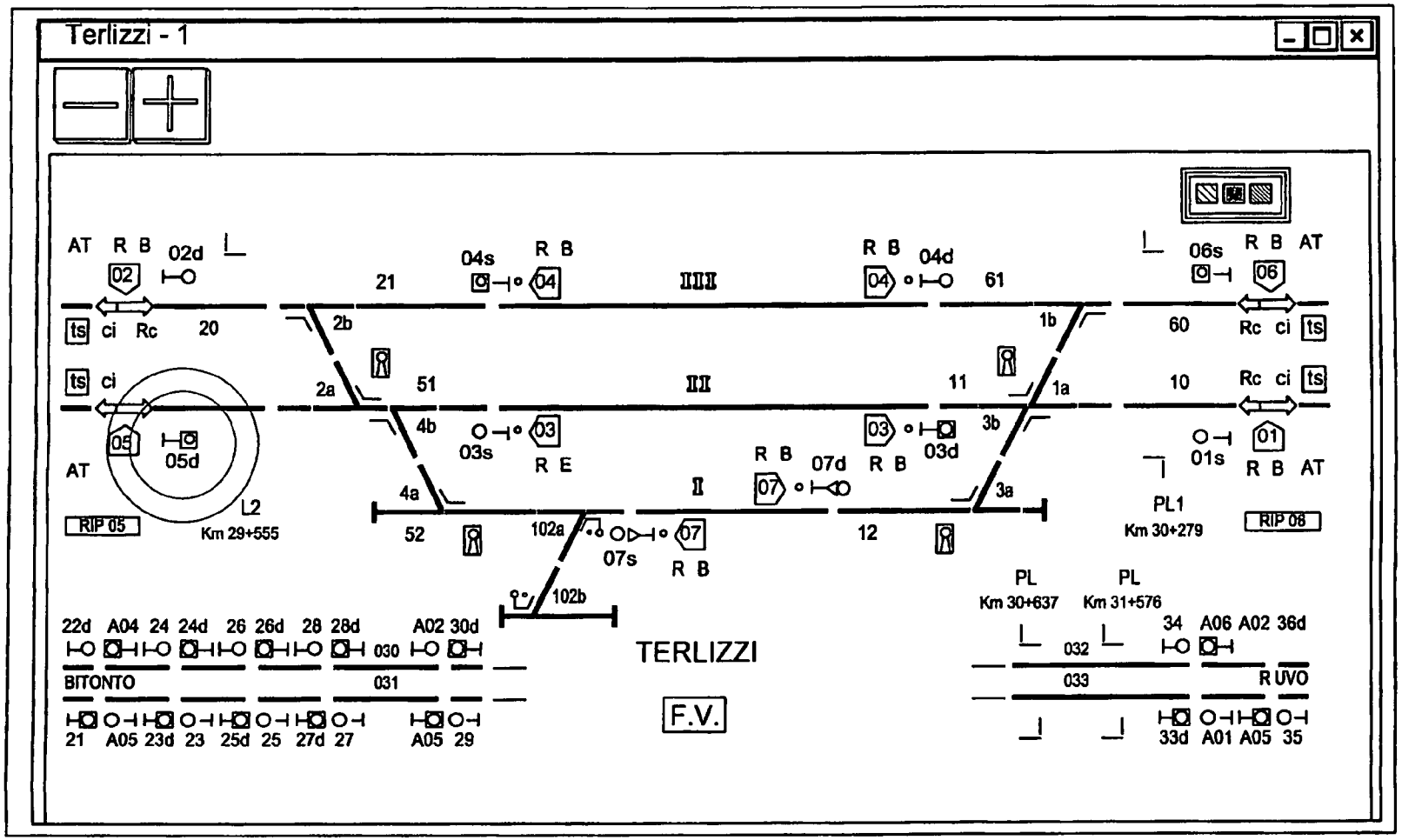
FIG. 4 shows an example of a display window of the system graphic layout, particularly of the station or the station region simulated by the device during test function of a command and control logical program of a railway system.

FIG. 4 shows an example of a screen showing what appears on a monitor during a test execution.

Figure 5:
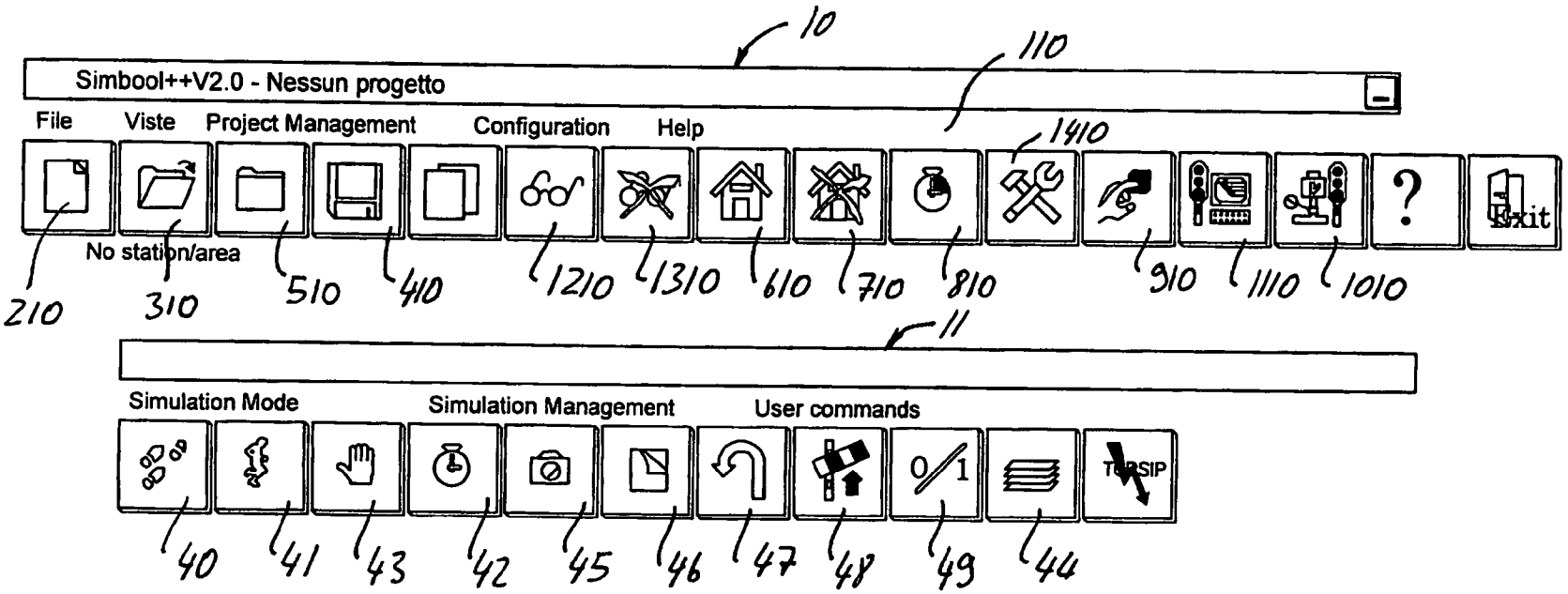
FIG. 5 shows two details of toolbars and instruments of starting windows for carrying out the verification by means of the device according to the invention.

The first screen that appears by starting the system is substantially similar to that of FIG. 5. A window wherein the top 10 allows to manage the application is opened, whereas the window 11 is the command bar for the simulation. This second window can be shifted by highlighting the top band and dragging it in a location useful for the user.

Directly below the main command line 110 (file, Views, etc.) a quick button bar is displayed to activate quickly some commands.

The meaning of buttons will be disclosed in sections that deal with the command itself.

Moreover a help command or button is provided which activates a help menu by which it is possible to enter or consult a guide file. The guide can be of interactive type or on line analogously to Windows® environment. Analogously to this environment once activated the command, a window of the guide appears from which it is possible to select display, printing options and so on.

File command in the command bar 110 allows to start a new project or to open an existing one, to save the current project and to save the current project and exit the application. The command options of file command are accessible by means of a typical drop-down menu which lists all the command options and it is possible to select the desired command therefrom.

Some or all the commands can be personalized and transformed by creating a routine in any kind of quick activation buttons.

Quick button 210 allows to start a new project, in order to define the whole background of a simulation, that is to define the stations to be examined, control windows which are desired to be activated, variables to be displayed, display modes, as for example the window aspect, colours, intermitting colours, displays with numerical wave-forms or of other kind.

If a project is already loaded in the device, the user is asked to save or eliminate the project by a communication window having command buttons for executing the above several options.

In order to save a loaded project it is possible to use the corresponding command of "file" menu or to use the save quick button indicated at 410.

When loading, the program controls syntax and semantics of configuration files and of graphic drawing file of the plant, of the areas thereof and of wayside equipments. Moreover, the simulator modules are identified, i.e. simulation programs of operating units, i.e. of wayside equipments and graphic display modes of wayside equipments or operating unit states, such as colours of graphic objects of the drawing. When said files include an irreparable error, the device does not load the file that has errors. Errors are listed in a summary box of a window displayed for each plant, station or plant area.

Figure 6:
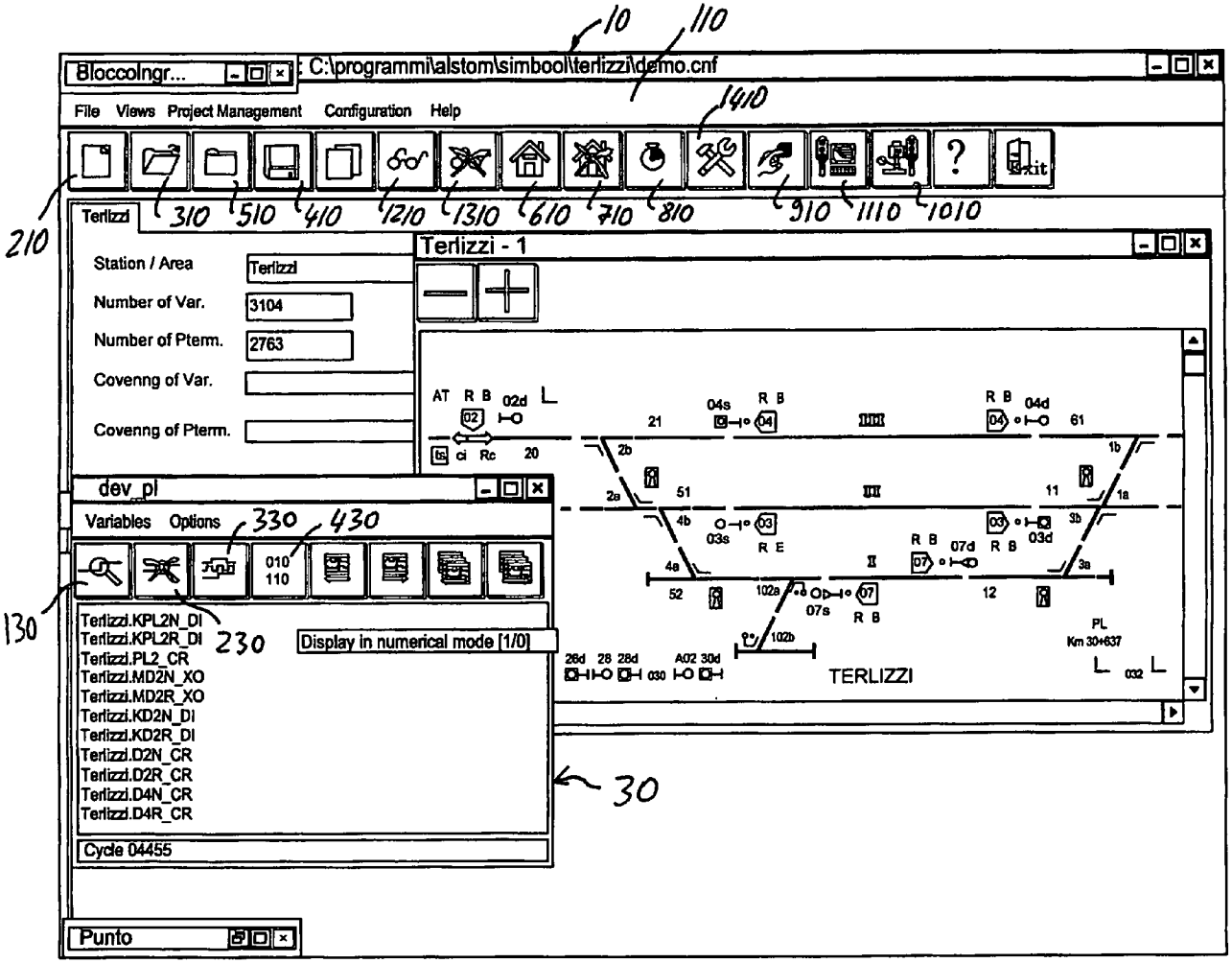
FIG. 6 shows an example of windows that are displayed when the complete simulating and test program is loaded and wherein a control window is opened for the appropriate equipment.

The finishing function is ended when the operator sends a confirmation and the result of loading is the opening of two windows 10 and 30 as shown in FIG. 6. In addition to the main window 10, is generally displayed even the control window 30 and the graphic layout of the plant or of the station or of the loaded area.

The loading of a project provides displaying of following data:

Name of the plant or of the station or of the area, number of variables which are included in equations describing the plant or the station or the area, number of Pterm, i.e. product terms obtained in the Boolean equations, of the plant, or of the station or of the area, the variable covering, i.e. the percentage of variables processed with the proceeding of the simulation and the covering of Pterm, i.e. the percentage that has been processed with the proceeding of the simulation.

The quick button 510 provides the closing function of a project. Project management menu that is accessible from the command bar 110 of window 10 makes available two commands that are Add Station/Area and Cancel Station/Area commands. To these commands quick command buttons are associated which are indicated at 610 and 710 in the quick button bar.

Add Station/Area command or the corresponding quick button 610 allows to add a new station or a new area to the project that is already loaded in the memory.

A dialogue window is displayed for specifying the Station/Area. The user can specify filenames belonging to the station or to the area that the user must type in a field of the dialog window. Instead of typing the name, the user can use a searching means which is accessible by means of a searching button. In this case a window is opened wherein saved stations or areas are displayed. With pointing means, the user can select and load the desired stations or areas among these in the list. It is also possible to select the format of graphic files that contain the station or area graphic drawing for example a CAD or TGIF file type.

By the "layout" button the user can specify the particular files constituting the station or area graphic drawing. Depending on the drawing format, a dialog window is opened to specify the corresponding station or area. In the predetermined field the user can indicate the drawing filename for example in CAD format. An auxiliary CAD file field allows specifying a file containing further graphical symbols to be naturally joined with the CAD drawing. When the selection ends, the program loads the station or zone configuration file and the station or zone drawing files. During the loading, files are syntactically and semantically controlled. If files have irreparable errors, the system does not load files containing errors. The program lists errors in a summary box. If a serious error occurs in the configuration definition file, the station or the area will not be made in the memory. If the loading is properly ended, the station or the area is made in the memory and the graphic drawing appears on the screen.

It is possible to execute the action of eliminating a station or an area from the project by means of Cancel Station or Area command or by means of the corresponding quick button 710.

The command bar 110 provides the additional "configure" command. This command provides the possibility of choosing between several options in a menu. A first option is the cycle time definition command. Even for this command a quick button is provided indicated at 810 in FIGS. 5 and 6.

The logical program for controlling and commanding a railway plant, particularly a vital control station apparatus, executes the reading of control signals provided by wayside equipments and the sending of command signals according to a cyclic operation. Typically the whole transmission and processing reading cycle is executed in about 500 ms. In each cycle the Boolean equations which formed the control and command logical program are recalculated. In the program of the device according to the invention, the user can set any cycle time corresponding to a real number. To this end, the quick button 810 or the menu command cause the opening of a window for setting the cycle time wherein it is possible to specify a cycle time.

The "Configuration-Modification suffixes" command, allows the determination of the suffixes. It is an important action since suffixes determine the behaviour and the semantic meaning of Boolean variables in the system configuration file, that is equation file. A wrong suffix definition may cause an irreparable error during the processing of the system definition file and this error disables the management of corresponding stations or areas or wayside equipments, i.e. of operating units. Suffixes have to be defined in compliance with similar definitions included in the system definition file, that is in the data file from which system EPROM memories are programmed. Settings of suffixes are executed with the help of a dialog window.

It is possible to use a box for modifying the suffix to specify suffix name. The name can include block letters. A "Type" drop down menu comprises all possible types that are available and selectable.

Suffix meanings are:

Input: It is possible to use variables of "input" type only on the right (element of a product term) of a Boolean equation into the system configuration file. When reference is made to a variable of "input" type on the left of a Boolean equation, as a result the program points out an error during the system definition file loading.

Output: Variables of "output" type have to be used on the left of a Boolean equation only once. When reference is made to a variable of "output" type on the right of a Boolean equation or more than once on the left thereof, the program points out an error during the system configuration file loading.

Current cycle: It is possible to use variables of "current cycle" type on both sides of a Boolean equation. A reference to the variable is possible only once on the left and so many times as desired on the right of equations which are successively calculated in the same cycle. If the use of a variable of "current cycle" type does not comply with the above norms, the program points out an error.

"Subsequent cycle": It is possible referring to variables of "subsequent cycle" type on both sides of a Boolean equation. These variables may be placed on the right of an equation (term) at any time. If a reference has been made to such variable on the left of an equation (result) it is not more possible to use it on the right i.e. in equations executed in the same processing cycle but calculated successively.

Shared input: "shared input" variable type is similar to "input" type having the only difference that the program updates these input values by using suitable "shared outputs" of other areas or other equipments after each calculating cycle.

Shared output: "shared output" type is similar to "output" type having the only difference that the program employs values of these outputs to update suitable "shared inputs" of other areas or other equipments after each calculating cycle.

Timed: "timed" type is similar to "current cycle" type. The difference is that the variable associated to "timed" type will be true if the equation calculating it is true and the delay time that is specified for the variable is expired, starting to count when the starting equation becomes true. If the variable associated to the timer has been previously calculated as true and the equation associated thereto is now calculated as false, the value of the timed variable will go immediately to false without any delay. An equation used to calculate a variable of "timed" type must be preceded by the definition of a delay, as indicated before with reference to the command for setting the system cycle time. The program point out an error if a delay for an equation of a non "Timed" type has been specified or if an equation of "Timed" type is not preceded by a delay specification.

Blinking Output FLS: this type of variable is equivalent to the "Output" type. The equation that calculates the value of a variable of "Blinking Output FLS" type must be preceded by an equation calculating the value of a variable defined as "Output". If equations do not meet this condition, the program point out an error.

Figure 7:
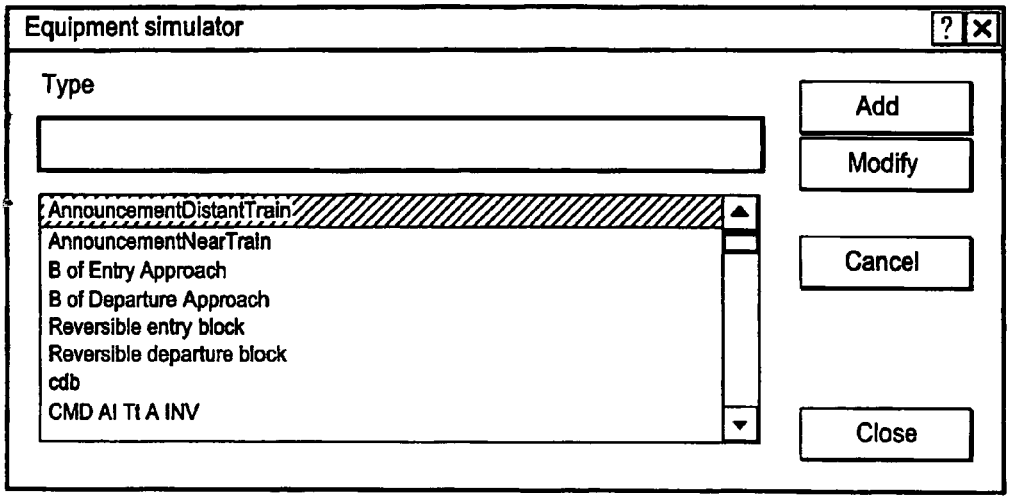
FIG. 7 shows an example of a window for the add and modify selection of simulating programs of system operating units, particularly wayside equipment.

The command bar comprises an additional command called "Configure-Add equipment simulator". Analogously to other commands, also this command can be activated by a quick button indicated at 910 in figures. By this command it is possible to define a physical piece of equipment or operating unit simulator. The definition of physical and logical equipment simulators consists in defining a model that is made in three steps:

defining a name for the new simulator;

interface specification;

designing the behaviour;

A window is activated an example of which is shown in FIG. 7. The window allows the selection of simulator name. The name may be typed in a suitable box of the window. An add button allows the addition of the specified name to an existing simulator list and at the same time it opens a dialog window for defining interface and the window of the truth table for the new simulator. If simulators having the same specified name already exist, the program denies the action and it opens a dialog window with an alert text to inform the user. By a modify button the user can modify existing simulators. Modification function allows the modification both of the simulator name and the content. The program enables the modification of more than one simulator at the same time.

For removing a simulator from the simulator list it is possible to use a cancel button which will remove the simulator whose name has been highlighted in a selection dialog box.

Figure 8:
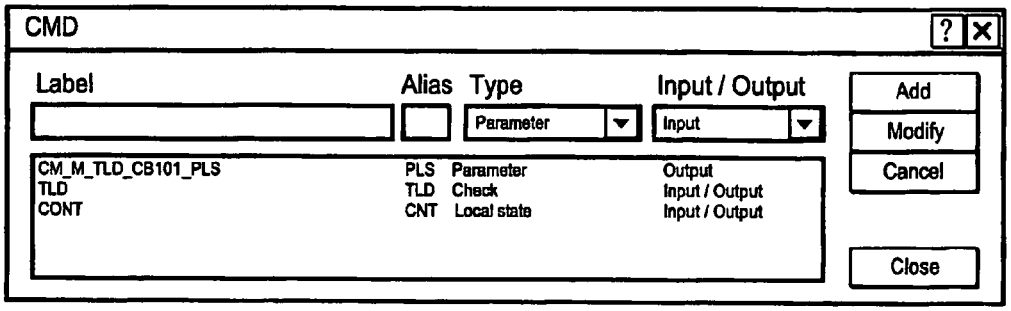
FIG. 8 shows an example of a window for the interface specification of each operating unit or equipment simulator defined by FIG. 7 window.

As regards the simulator interface constituting the second step for defining each simulator, this is composed of a form set and of corresponding alias, types and functions. To specify the interface a dialog window for defining the interface is displayed as illustrated in FIG. 8.

The user can specify a form by using a "modify" command button provided in said dialog window. This form is used to identify the variable right name during the simulator-variables association. A form can include parametric or constant components in arbitrary order and depending on the syntax of the form itself. The form definition is an obligated step. Alias is the form short name and it is used to identify the form in the truth table of the simulator. Alias name has to be defined in an alias box in the interface definition dialog window and this name specification is necessary.

The form type substantially describes variable rule which are represented by the form in the simulation. It is possible to select the used type with a "type" option box.

The variables types are:

Parameter: the parametric type variables represent the outside simulator interface. The equations of the vital computer station apparatus control the simulator by using these variables, if they are defined as "inputs". If variables are defined as "outputs" this means that they are used as equation input variables of the control and command logical program to determine and to update the system state.

Control: Such variables are used to control the simulator behaviour. These variables are associated to buttons to offer the user an interface that allows to modify the simulator behaviour during the simulation or to simulate possible failure situations. Control variables may have input or input/output attributes. The output attribute is not inhibited but it has no meaning in the case of control variables. Variables with "input" attributes are associated to a button that is pressed by clicking with the mouse and released with another click. If a variable is provided with input/output attributes both the simulator and the user can set the button state. For example the user clicks on a button to activate it and the simulator can release it after some action cycle. The form associated to "control" type can include only constant components.

Local State: "local" type variables are used to memorize simulator internal states. That is to say that this kind of variables allows the defininition of a sequential behaviour and not only a combinatorial behaviour. These variables are not visible from the simulator outside. These variables may have only input/output attributes. The form associated to the local type variable may include only constant components.

Input and output attributes may be selected by using an "input/output" option box.

After having specified form alias, the type and "input/output" attribute, the user may add these information in the interface by an "add" button command. Both the specification of the alias and the specification of the form are obligatory and must be univocal.

It is possible to modify the specified attribute group such as form, alias, type and "input/output" by a selecting action in the dialog window list and by using a "modify" function button. Analogously it is possible to remove a specified attribute.

The third step for the simulator definition comprises the functional behaviour design. To this end the program is provided by a window with a truth table (see right side of FIG. 9). This window is automatically opened when the user defines that the addition of a new equipment simulator is desired. The truth table is divided into two parts separated by a thick vertical line. The left part of the truth table represents the simulator current states, while the right part is the subsequent state. The table includes a column for each variable defined in the interface. Variables with "input" attributes appear on the left, while variables with "output" attributes appear on the right. Variables with "input/output" attributes appear on both sides. The table header includes variable alias names.

Figure 9:
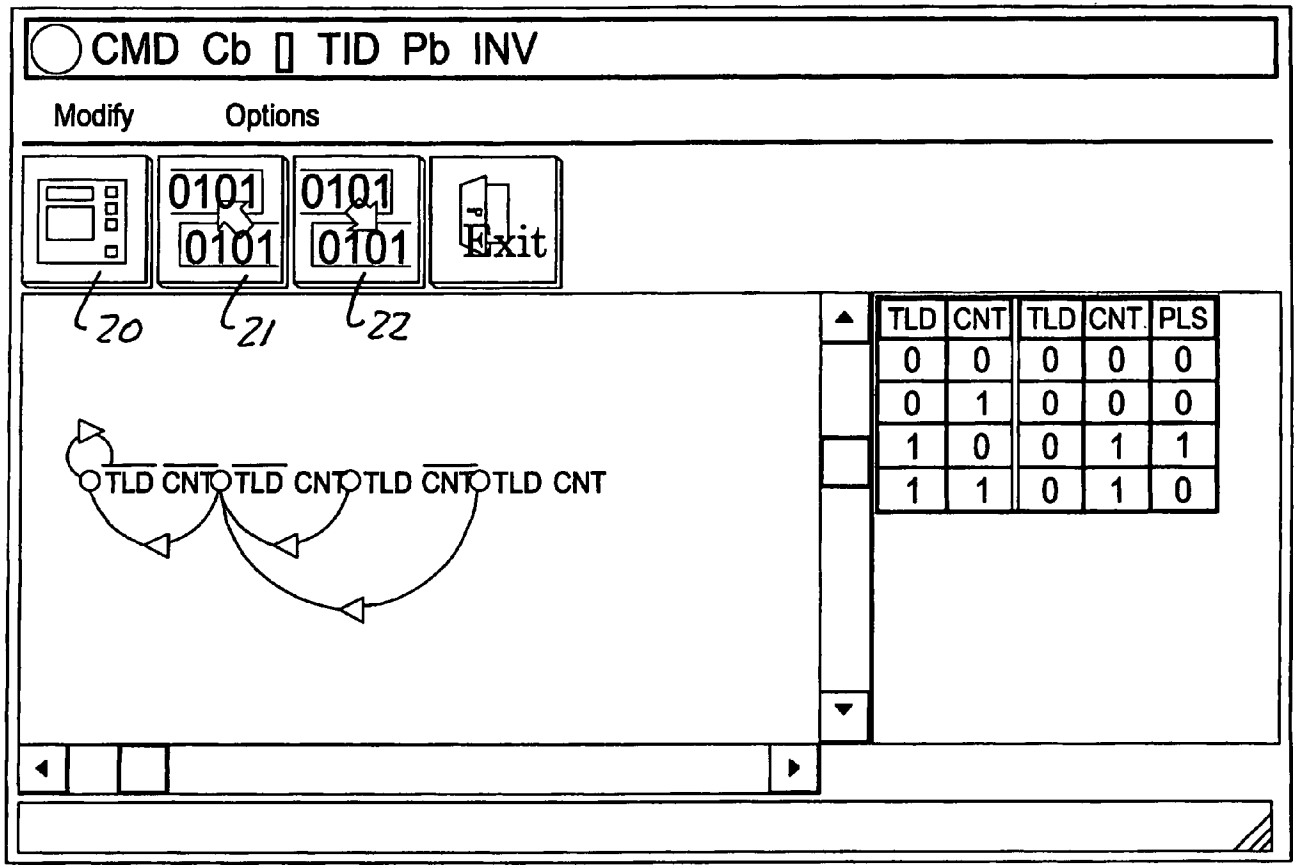
FIG. 9 shows an example of a window for executing the specification function of the behaviour of the operating unit or of the equipment in relation with the virtual model composed of the Boolean simulator that describes it.

This representation allows to design both sequential and combinatory logic which functions for model the simulator behaviour. If a user designs a sequential logic (i.e. a logic including "input/output" attribute variables) on the left side appears Markov logic model. Circles represent logic states, while arcs are transitions. Positioning on arc arrows, the program displays the possible input states to start the transition and the output states set during the transition. The window structure is shown in FIG. 9.

In the case of a new simulator, the right side of the truth table includes "+" characters representing a not initialized state. The user can overwrite the values in the cells of the right side (outputs) by clicking on a cell with the mouse button. Practically this means to define that determined output state when input conditions appeared (left side of truth table). The table of FIG. 10 sums up value meanings that can be assumed by each single cell of the truth table.

"*" value is a cell value not initialized.

"X" value means that if said value is given to a cell on the right side of the truth table, in the same row even all the boxes of the left side will have "X" value. This means that the state identified by the corresponding row is not available. Practically this is a combination that is not admitted or used during the simulation.

"0" value means that when input conditions in this cycle are verified, next cycle output will go to "0" value.

Analogously the "1" value allows that in the subsequent cycle the output will go to said "1" value.

In order to help the user the window offers further functions illustrated in FIGS. 11 and 12.

It is possible to enter functions not only by menu commands but also by quick buttons, as will be described hereinafter.

Modify-Parameters command can be executed also by the quick button indicated at 20 in FIG. 9. This command closes the interface definition dialog window. When the dialog window is closed it is possible to open it by clicking on said button or by using the command.

Modify-Copy command or the quick button indicated at 21 in FIG. 9 allows to select and to highlight any square area of truth table using the mouse as selection and activation tool. The selected area can be copied in note file.

Modify-Paste command enables the control of the content of noted in a selected area. The selected area has to correspond in size to the area that has been memorised in notes.

Other commands are accessible in this step. For example the user can modify colours whereon selecting, modifying character fonts or task layout fonts.

The Association function of equipment simulators to variables enables the simulation of the simulators defined in the system to a suitable variable group. Such function is activated by means of Device Configuration-Definition command or by means of the quick button indicated at 1010 in FIGS. 5 and 6. To create a link between a type of simulator and logic variables associated thereto the user has to specify the station/the area or the equipment to which it is applied, the type of simulator and the label of the wayside equipment or of the command to be simulated. To help the user it is possible to select these pieces of information by using option boxes of a dialog window. Option boxes allow loading the name of the area, of the station or of the equipment already defined, the defined simulator type and, if there are loaded drawing files, the label included in graphic objects of drawings. Even if the program prompts the possible information, the user is free to type any desired string. Such possibility allow to specify simulators which will be realized later, to make reference to a non-loading station and to specify the objects to be simulated which have not a graphic representation in drawings.

The association between variables and simulator occurs during the project loading process that is made after pressing the close command. If the loading process is not capable to carry out the desired association, the program points out an error and displays a message into the loader dialog box. These association errors do not prevent the simulation that goes on with valid associations. The identifying string may include one or more labels separated by a "," character. The identifying string has to correspond to forms defined in the interface of the associated simulator. The program prevents the multiple definition of a descriptor by displaying a proper error message.

The definition of colours and states of the drawing objects occurs by means of the Layout Configuration command in Configuration menu or by means of the quick button indicated at 1110 in FIGS. 5 and 6.

The state and colours of a graphic object that represent a wayside piece of equipment, an area or a station, are determined by a variable group defined in the station/area configuration file. The variable group is described by using a form for each variable of the group. These forms are used to find variables during the step of "assignment of state and colours to the drawing". As in the equipment simulator definition, it is possible to define the state and the colour of drawing objects in three steps:

Type of graphic objects included into the drawing;

Specification of interface, to be done for each element that has been added or modified during the preceding step (type of graphic objects);

State and colour of the drawing objects, to be done for each interface of the preceding step.

Therefore the first step is the specification of graphic objects types included into the drawing. To this end by activating the Configuration-Configuration Layout command or by pressing the 1110 button, the program displays the dialog window illustrated in FIG. 13.

The user can type the name of new definition of graphic object in the "Type" modification box of the dialog window. The subsequent steps for defining the interface and for defining colours occur by adding and modifying elements.

Figure 14:
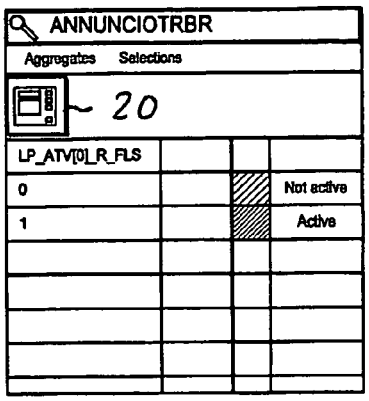
FIG. 14 and 15 show additional windows to execute functions for modifying or adding graphic aggregates accessible by buttons of the window for selecting graphic aggregates according to FIG. 13.
Figure 15:
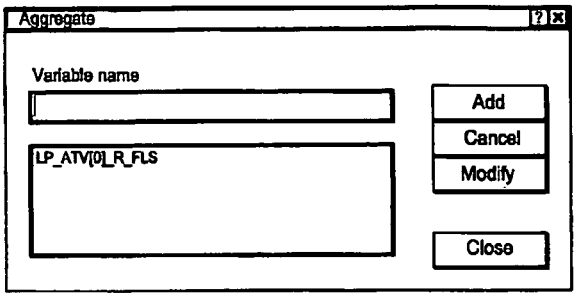

When the modification option is activated, by means of a correspondent button, two new dialog windows are opened shown in FIGS. 14 and 15 respectively and which windows allow to modify or add graphic objects.

The interface specification occurs during the second step for defining the state and the colour of objects. The interface is a variable group to determine the current colour state of graphic objects. It is possible to define the variable group by using the dialog window illustrated in FIG. 15. The user can specify the variable name in the provided box by using the same syntax of which it has been already said discussed. Analogously to what has been already described more times referring to other functions, the dialog window has various buttons among which the Add button. In this case, such button causes a routine to add the specified for into the variable form list. The program controls the form from a syntax perspective. Moreover, the program removes the wrong form and sends an error message that is displayed in the message area. The program prevents using suffixes which are not defined in forms.

After the interface specification, it is necessary to define the state and the colour of the drawing objects. The user can specify a state text, an outline or filling colour for graphic objects of the drawing by using the table of FIG. 15.

The window which can be resized to the maximum screen size includes variable list (forms) of the first row (header). The table, as already said, is divided into two parts separated by a thick vertical line. The left side of the table includes state table that can be scrolled by the underneath cursor or individually if the state table is bigger than the window, whereas the right part includes coloured signalling and the associated text. The user can specify form states by clicking on a cell with the mouse, the program displays a summary box for selecting the cell value. Entries of state summary box are:

"0": this entry set the variable form on false.

"1": this entry set the variable form on true.

"X": this entry removes the whole row containing cells that have been activated by the mouse.

It is possible to add a new row to the definition table by clicking with the mouse on a cell of the first empty row in the state table. In this case, the program displays the same above state table, but the selected "0" and "1" values are used to initialize the whole row. If the row has been initialized is than possible to set the desired values for each cell of the row as described above.

On the right side of the window are indicated the selected colours for the signalling. It will be noted that each box is a square with an internal colour and an outline or frame colour, both colours being alterable. For each row that has been filled in the table, it is possible to define a colour for outlines, a filling colour and a state indication text. After having defined a row, the program assigns the predetermined colour and state and displays the colours and state into the two columns on the extreme right of the table. The predetermined outline colour is intermittent light grey, whereas the filling colour is intermittent dark grey and the predetermined state text is "no defined state".

It is possible to modify the outline colour by clicking on the thick edge of the colour definition square in a row. In the same way it is possible to modify the filling colour by clicking with the mouse on the internal square of the colour definition square. To modify colours a dialog box is displayed. Even the flashing attributes may be modified in an analogue way as hereindescribed by using the mouse and clicking with the right button on the section that is desired to become flashing. The flashing is ended by repeating this action. It is also possible to modify the state text by clicking with the mouse on the text to be modified in the extreme right column of the table.

According to a further characteristic of the device of the present invention, the device may comprise means for connecting to a network for the connection to workstations or to other remote devices. The network can be realized according to various protocols. The network protocol that is generally used is the TCP/IP protocol due to its great spreading. The remote unit can be used to control the device and also to load and execute pre-existing simulation command files that have been previously written. Said command files called "batch files" can be also directly loaded in the device by means of proper and known reading interfaces, as for example files that are memorized on floppy disks, CD-ROM, or the like.

However in both the above cases it is necessary that batch file commands are translated in a language that can be executed by the application of the device according to the invention. To this end a translate table is provided called conversion table. This one is offline written and must be loaded in the device according to the invention before executing the batch file or before executing the connection and the command from a remote workstation.

The condition table selection command allows selecting a Condition table indicating the path. A dialog window is opened as the one illustrated in FIG. 17. The Condition Table file path can be directly written or a search function can be activated by means of a "Search" button provided in the dialog window. When the Condition Table file is found, by selecting this file it is possible to confirm its loading by means of a function button provided in the dialog window.

Figures 17, 18:
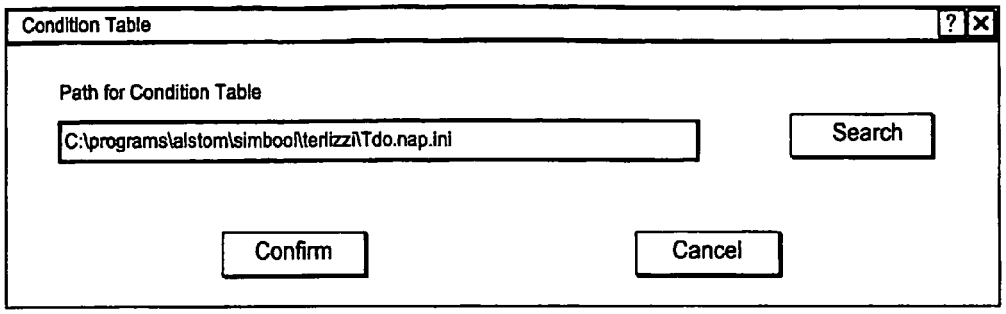
FIG. 17 shows a window for selecting and loading a "Condition Table".
FIG. 18 shows a structure table of a "Condition Table" file.

Advantageously the Condition Table file is structured with a structure similar to that of Windows files .INI. FIG. 18 illustrates the basis of this structure.

FIG. 19 comprises an example of a Condition Table file. In order to make the information intelligible by the Boolean equation system constituting both the control and command logical program to be tested and the logical simulators of the wayside equipments, of stations and/or of the areas, the condition table substantially includes the behaviour rules of the plant, that are rules for assuming the several operating states of wayside equipments in predetermined operation condition.

As already said before, the device allows not only checking the final behaviour of the control and command logical program on the station or area reproduced by Boolean simulators, but also to check the internal behaviour of equation system. This occurs by means of control windows that can be defined in relation to the number by the user himself. The user can assign any desired variables to each single control window. The program of the device keeps a chronology for each variable to allow the user to recall the preceding states by using control windows. The tool used to define control windows is a tool called "Views". Such tool allows the opening of a menu that comprises various options. An option is the Add Control Window command. The command is also accessible by a quick button indicated at 1210 in FIGS. 5 and 6. This command allows opening a new control window. For each new control window it is required to specify a name that must be univocal and for the name definition a new dialog window is opened. A typical control window is illustrated in the figure and where it is indicated at 30. An open control window has a toolbar that functions to set variables to be displayed moving inside the chronology. Analogously to what already described before in other cases, commands are always accessible alternatively by a choice in a drop down menu or by means of quick buttons.

Add variable command or the quick button 130 allow to selecting variables to be controlled. It is possible to pre-select variables to be displayed by using a search dialog window.

The search dialog window provides various buttons that allow to perform functions such as to cancel the selection, to add a selected variable, to cancel one or more variables and to confirm the selected variables in the control window. It is also provided a button for cancel the current selection process.

By the Cancel Variable command or by the quick button 230, it is possible to remove a displayed variable from a control window. Even in this case, as in the preceding command a dialog window is displayed to execute the command and this window has buttons for activating specific functions such as Cancel, Cancel all, Close.

The Display Wave/Numerical Form command or quick buttons 330, 430 allow the selection of wave or numerical display modes of variable/variables which are displayed in the control window.

Analogously it is possible to provide commands or quick buttons to scroll or browse among the various possible control windows that are defined by the user.

The Cancel Control Window command or quick button 1310 cause the cancellation of a control window. In this case a dialog window is displayed wherein all the opened control windows are listed and among which it is possible to select the control window or windows to be eliminated, the cancellation being possible by means of a "Cancel" button.

Figure 20:
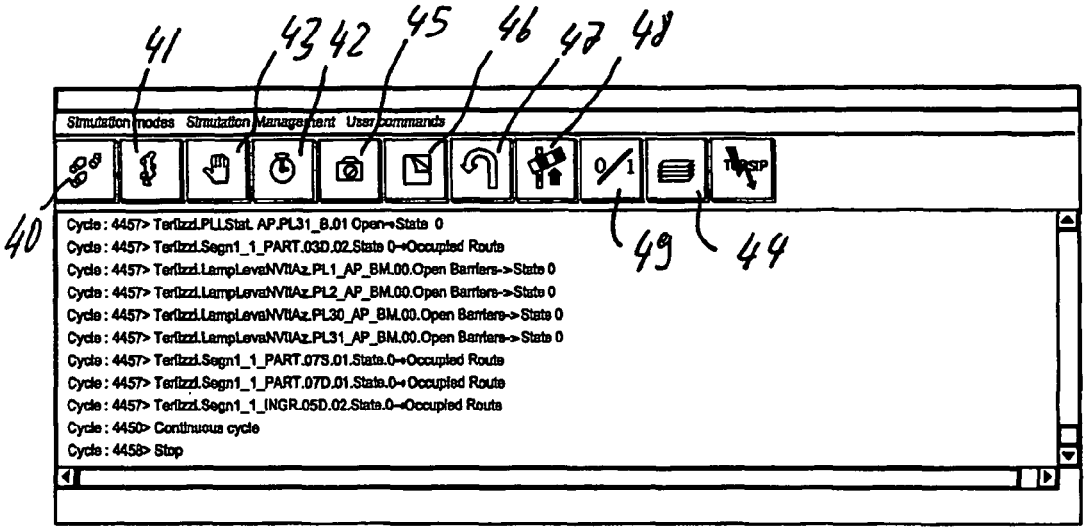
FIG. 20 shows an example of "Simulation Commands" window.

A further command is the simulation command named View_Activation of command Bar. The command bar can be activated and disabled by this command that is available also as quick button indicated at 1410 in FIG. 6. To give commands to the simulator, the program displays a control window that is illustrated in FIG. 20. The control window is composed of a toolbar for commands and an area for messages, to display commands and modifications during the simulation execution. Quick commands in the shape of quick buttons are also available, drop down menu commands are also available for these commands as already provided for other commands.

By the simulation Mode command the user can select various options in a drop down menu. Among these options the following are important:

Single cycle option, that can be activated also by means of quick button 40. This option allows the execution of a single calculating cycle. After the execution the program automatically updates the message window and/or window/windows comprising the design/layout of the station or the area according to the new state.

Continuous cycle option accessible also by the quick button 41. In this case, the program starts to calculate in a continuous way cycle after cycle. During calculation, the message window and/or window/windows comprising the design/layout of the station are automatically updated.

Multiple cycle option. Even this option can be activated by a quick button 42. It is possible to specify a certain number of cycles to be calculated continually. The specification of the number of cycles is made by a dialog window wherein it is possible to indicate the desired number of cycles.

The calculation can be stopped in any moments by a stop command or a quick button 43.

Finally there is also a batch command or a quick button 44, with which a batch file is loaded and executed comprising an already made predetermined sequence of commands. The batch file execution is similar to a macro execution. As already said before, batch file commands have to be translated by a conversion table and must have a predetermined structure. Batch files can be edited by means of a text-editor such as Write® or Word-pad®.

The Image file Generation command or the quick button 45 enables the memorizing of the current state of simulation in a file so-called "snapshot". Snapshot file is saved by the user command with a name suggested by the program and including the date and the current hour.

The Reload Image file command or the quick button 46 enables the restoring of a specific simulation situation by calling up a snapshot file previously memorized. Obviously to select the snapshot file to be call up the program displays a dialog window wherein it is possible to select the desired snapshot file and open it.

By a restart command or a quick button 47 it is possible to restart the simulation. After a restart all the equation system variables and the simulator are set on value "0" and the cycle counter is reset. To start again the simulation it is necessary to execute a reset sequence of the normal state of wayside equipment simulators.

The User Commands command opens a drop down menu that enables the access to the Commands Management and Variable Value Definition functions.

Figure 21:
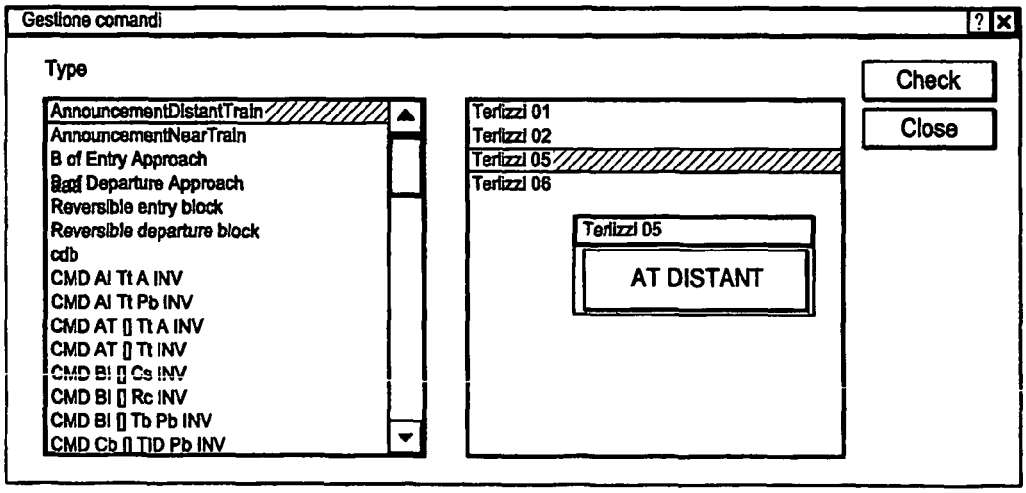
FIG. 21 shows an example of a window for managing simulation commands accessible by quick button or menu command in the window according to FIG. 20.

The command management can be call up also with a quick button indicated at 48. By this tool it is possible to modify simulator behaviour of each type of equipment (both physical and logic) by using the button associated to the control variables defined during the simulator configuration of equipments. To access the proper button the program displays the dialog window illustrated in FIG. 21. The list on the left of the dialog window includes the existing types of simulators. The user can display the simulators in the list of the dialog window by clicking with the mouse on the selected type. Simulators are identified by the first element of identification strings that has been specified during the simulator-variable association described before. It is possible to call up control buttons by clicking with the mouse on the desired simulator and by pressing a "control" function key.

Figure 22:
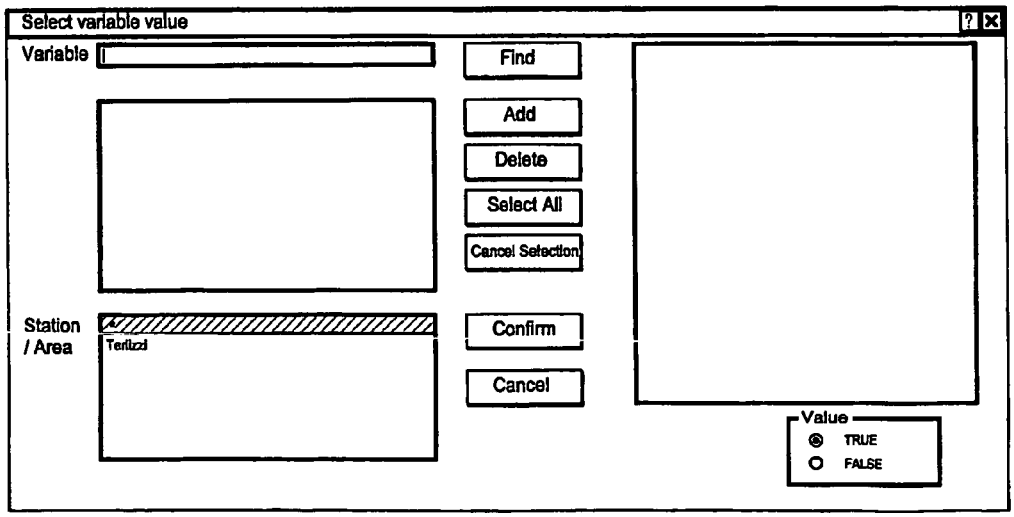
FIG. 22 shows an example of a window for selecting the variable value accessible in the window according to FIG. 20 by quick button or menu command.
Figure 16:
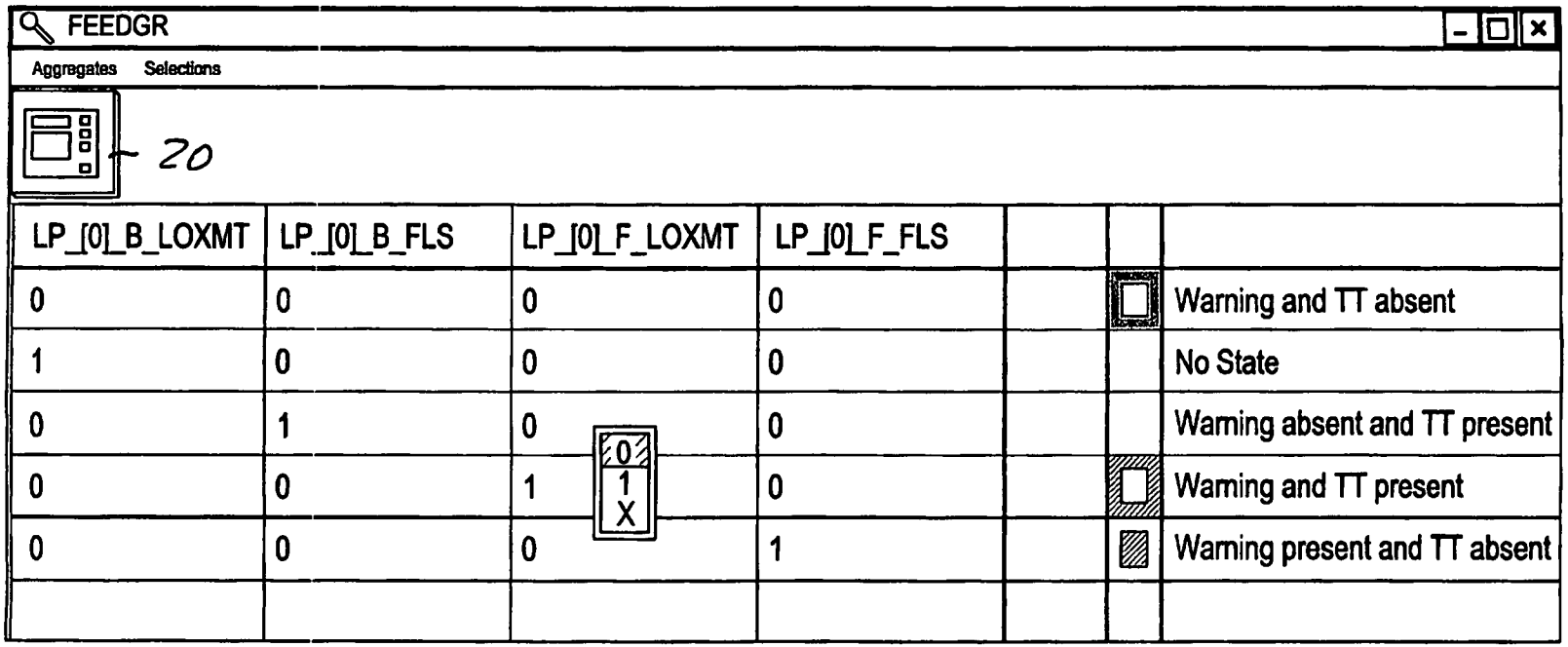
FIG. 16 shows an example of a window to execute the state and colours specification of graphic objects.

In the alternative, by the user command menu it is possible to select the Variable Value Definition command. Also this command may be activate by a quick button indicated at 49. This command or this tool allow setting manually the variables used in the simulation. To select the variable a dialog window is display as the one illustrated in FIG. 22.

The dialog window is very similar to the one used to select variables to be controlled. The selecting procedure is similar to that of "control of variables". To set the desired or proper value it is possible to use two choice options located in the bottom corner on the right of the window and selectable alternately "True/False".

The button indicated at 50 allows activating the remote connection procedure to a remote unit.

According to a further feature and referring to FIG. 4, the state and colours of a graphic object in the layout of a station or of a zone or of a plant may be modified simply by clicking with the mouse on the graphic object in the drawing.

The example that takes cue from FIG. 4 uses the signal 05*d* circled in black and placed on the left side of the illustrated layout. The program displays a dialog window to set colours and state.

In this window is provided a "label" field containing the internal label of the graphic object extracted by the corresponding TGIF or CAD drawing file. The user cannot modify it. The content of this field is used to solve the "0" parametric components of forms. An "Auxiliary String" modification box enables the definition of the parametric components of forms. Each parameter must be separated by the "," character. The parameter indexing starts with 1, referred to the elements comprised in the auxiliary string. The string specification is not obligatory.

Additionally it is possible to use an "alias" modification box to specify the alias name of the specified object. The alias name is used to replace the label extracted from TGIF or CAD file when the program lists, in the command window, the objects that are changing their state during the simulation. In this modification box it is possible to input any character. The specification of alias names is not obligatory. The program prints the original labels in the command window when alias are not specified.

A "Type" list contains the colour and state tables previously defined. The user can select one of these. If the object has already a defined colour and state table, the list automatically highlights the current "type".

It is also possible to set the assignment for a graphic object by clicking with the mouse on a confirmation button. The setting of new colours and state occurs after the subsequent simulating cycle. If forms of a specific type cannot be found by using a specific label and the auxiliary string, the program sends an alert message and ignores the assignment.

Analogously to other functions already described, the dialog window comprises or may comprise other function buttons with a Cancel button that enables the canceling of the assignment or Cancel that allows ignoring the assignment.

Referring to a further advantageous feature, the device according to the invention may comprise also a function for executing different automatic test backgrounds both on Boolean simulator tool and on the tool used for the final functional test of the plant. Obviously, the execution of this function allows the opening of a window that allows to select commands, options or to select graphic or control objects, analogously to what previously described for other functions.

With the starting of graphic interface constituted of said window, lists for selecting areas, type of pieces of equipment of the station plant are displayed together with corresponding data relevant to the station under test. The user must select an element inside each lists i.e. an area and a type of equipment. Now, the program provides to display values relevant to the equipment list of the selected equipment type of the selected area and the list of automatic tests which are available for the selected equipment type.

The user has the possibility of selecting one or more elements from the above lists i.e. selecting one or more equipments upon each of them one or more automatic tests can be executed. In the lists to each selection corresponds the display of the selected element in correlated lists. The correct selection that has been made respectively of an area, equipment type, equipment label and of the test label allows to start the execution of the test by means of a "Launch Test" button. The user is asked to confirm the test execution in a dialog window. If the response is affirmative, in the text box identifying the sigma "execution test" will be displayed the label of the current test and of the equipment that is object of the test, while in another list of the graphic interface will be displayed report messages.

After starting an automatic test, the button "Launch Test" label changes in "End Test", giving the possibility to stop in any moment the automatic test. After the stopping of a test, the button label changes again to "Launch Test" state. It is also possible to execute individually a single command.

An example of automatic test background is shown by the corresponding report file enclosed to A1 to A4 pages. The test is called "switch points on route (on routing)". During the test the covered switch points of a route firstly are locked in opposed position with respect to the one expected by the route itself. Then the test background, by commanding it more times, checks that the route does not block until all switch points are free. It should be noted that the complete test execution provides a series of other actions that are not subject of the present invention and that are not quoted for shortness reasons.

Referring to FIG. 1, the device according to the invention may be used in conjunction with another device called Boolean validating or checker.

In this case it is a hardware/software device, i.e. a computer or a personal computer that can be even the same computer of the device according to the present invention and wherein a program for executing the check of the control and command logical program is loaded, i.e. a checker of Boolean equations. The check program may be of the type operating according to a diversity principle. Particularly the Boolean checker may be composed of a comparator executing a comparison between the command and control logical program, which is in the test step in the device according to the invention, and a further control and command logical program which has been generated by generating means different from that during the test step. It is possible to execute the comparison both regarding the Boolean equation system of the two control and command logical programs and regarding the results of the simulating test executed for both the programs.

In case, even the programs simulating operating units, i.e. station equipments, areas or stations may be subjected to a similar diversity test with the help of the Boolean checker.

According to a preferred type of checker this is composed of an independent program that is executed on a different computer or on the same computer of the device according to the invention. This program executes in parallel the test of the Boolean equation system constituting the control and command logical program that is subjected to the check. In this case, the same logical program for controlling and commanding the railway plant is subjected to a dual check test by means of railway plant simulation according to what described above with two disjoint programs and the behaviour of the simulated plant obtained under the control of the control and command logical program in the two disjoint and parallel check tests is compared, error or alert files being generated in case of differences.

Figure 23:
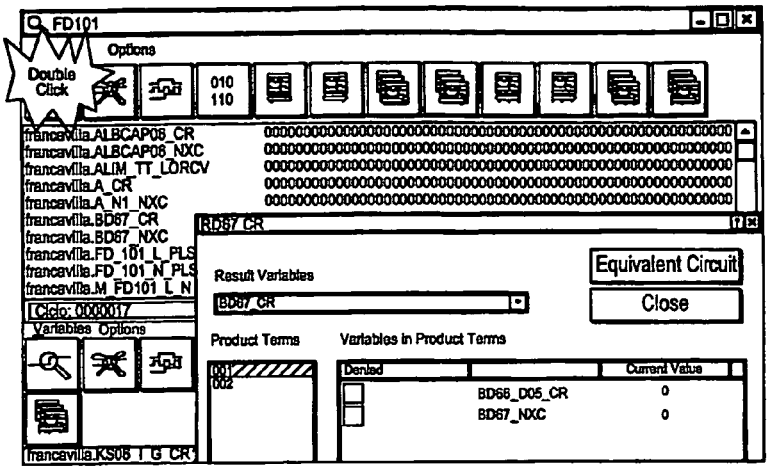
FIG. 23 shows a window for displaying Boolean equations of the control and command program.
Figure 24:
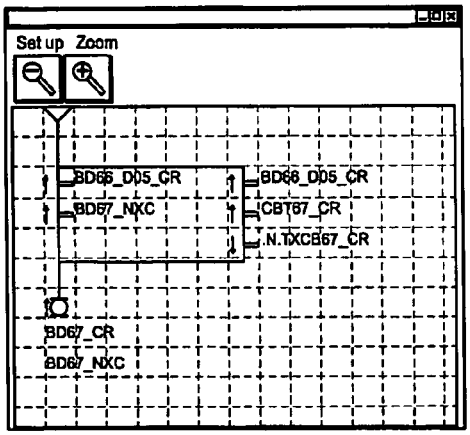
FIG. 24 shows a window for displaying the equivalent circuit of a Boolean equation of the Boolean equation system composing the control and command program during the test step.

According to a further feature of the invention, for each of the Boolean equation of the equation system that compose the logical program for controlling and commanding the railway plant, it is possible to display both a list of product terms that are part of the displayed equation and the circuit corresponding to said displayed equation. FIGS. 23 and 24 show the window for selecting equations and the window for displaying a circuit corresponding to one of said equation. The selection and the opening of the corresponding circuit can be activated by buttons or by means of the mouse.

According to a further feature of the invention, the device comprises a program for designing and generating Boolean simulators of equipments or operating units that enables the tracking of new pieces of equipment with new behaviours.

Equipment can be composed of basic components, i.e. components for simulating a basic function and of complex components, i.e. a group of basic components operating in the sphere of an equipment simulator having a more elaborate structure.

A basic component may be created or selected by a list of existing components or crate. The basic component generating window is substantially similar to the one of FIG. 9. Obviously in FIG. 9 it is a component already generated or close to the generation. Analogously to what already said, a state table is generated wherein input variables, output variables, control ones and comments are defined. Variable values are selectable analogously to those provided for truth table and the provided functions are similar. The automaton illustrated on the left side of FIG. 9 (substantially similar to the one for generating the equipment simulator) is the Markov automaton, wherein states are represented by circles drawn along an horizontal line, by using distances calculated according to the description of the longer state. The description of the state is indicated by variables on the right of the circle, the state is composed by the local variable alias, the variable assuming the "false" condition being illustrated with a mark on it. On the contrary, state transitions are illustrated by arcs going from initial to final state and the direction of the state transition is indicated by an arrow upon the corresponding transition arc. By putting the mouse cursor upon the arrow of a transition arc are automatically displayed transition conditions as one or more input, control and output variable group. Circle and arcs colours are given in a different way depending on the configuration choices that have been set.

The individual basic components defined in such way can be combined or associated therebetween to form complex components, being interfaced therebetween by means of the indication of interfacing variables or input and output internal variables.

Figure 25:
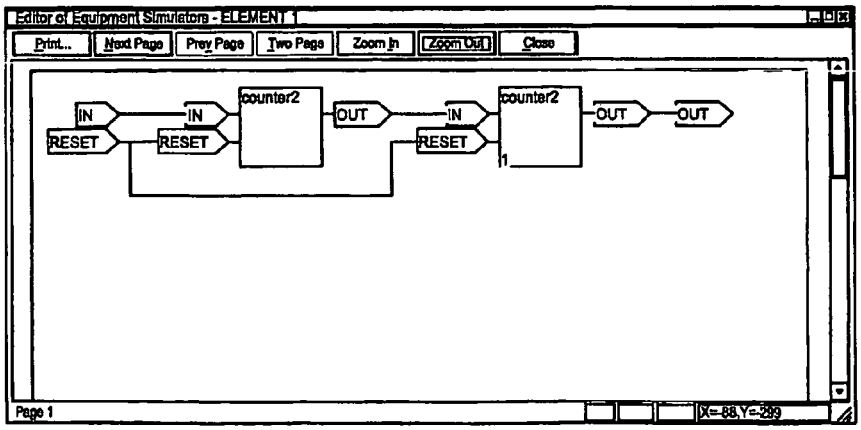
FIG. 25 shows an example of a window for displaying the circuit of a simulated piece of equipment.

It is also possible to display a block diagram of the structure of the equipment simulator as appears in FIG. 25.

It is clear from what disclosed before and as results from FIG. 1 that the device according to the invention may be provided also as a device always existing in the system for controlling and commanding plants as a further non-vital node which can be activated both in emergency mode to execute periodical checks of the control and command logical program as well as backup unit or even as a device to modify and upgrade the control and command logical program when the system is modified with the removing or the addition of stations, areas or wayside equipments.

With regard to the device according to the invention it is generally clear that it may be employed in any plant having structural analogies with the described railway plant and that terms like station plant or plant area, operating unit and wayside equipment are similar terms.

The invention claimed is:

1. A device for checking a logical software engine for controlling and commanding a railway plant comprising a plurality of wayside operating units, the device comprising:

a central processing unit generating a command signal to the plurality of operating units, the plurality of operating units being configured to receive the command signal and generate a control signal about an operating condition, the control signal being transmitted to the central processing unit, the central processing unit reading the control signal and processing the command signal according to an operation protocol; and one or more memories storing a logical engine commanding the railway plant, a plant simulation program, and a graphic program, wherein the logical engine commands and controls the simulation program, wherein the plant simulation program simulates a railway plant structure and operating modes of the plurality of operating units, the plant simulation program comprising a control and command logical program and a simulation program representing operative functions of one or more plant components, wherein a plant component is an operating unit, a structural element, an area of the railway plant, or the entire plant, and the plant component is univocally associated to a virtual image of the plant component generated by the graphic program, wherein the graphic program generates a different image of each plant component by representing a different graphic aspect condition of the plant component, each aspect condition being associated to a predetermined value of a state variable describing the operating condition of a corresponding plant component, or to a command variable commanding a commutation or a maintenance of an operative state of the plant component, wherein different virtual images corresponding to the different graphic aspect conditions of the plant component are different one from the other and reproduce schematically real modifications of aspects of the plant component in different operating conditions, wherein the plant simulation program comprises one or more Boolean algorithms including variables, and wherein the variables are defined to represent the control signals of different state or operating conditions of the plurality of operating units, and the command signals for commutating and maintaining the different state and operating conditions of the plurality of operating units.

2. A method of checking a software logical engine for controlling and commanding a railway plant comprising a plurality of operating units, the method comprising:

providing a central processing unit generating a command signal of the plurality of operating units, the plurality of operating units receiving the command signal and generating a control signal about an operating condition, the control signal being transmitted to the central processing unit, the central processing unit reading the control signal and processing the command signal according to an operation protocol;

storing a logical engine, a plant simulation program and a graphic program in one or more memories, the local engine commanding the railway plant, the plant simulation program simulating a railway plant structure and operating modes of the plurality of operating units, the plant simulation program comprising a control and command logical program and a plant component simulation program representing operative functions of one or more plant components, wherein a plant component is an operating unit, structural element, area of the railway plant, or the entire plant;

causing the logical engine to command and control the simulation program; and univocally associating a plant component to a virtual image of the plant component, the virtual image being generated by the graphic program, wherein the graphic program generates a different image of each plant component by representing a different graphic aspect condition of the plant component, each aspect condition being associated to a predetermined value of a state variable describing the operating condition of a corresponding plant component, or to a command variable commanding a commutation or a maintenance of an operative state of the plant component, wherein the virtual image of the plant component is a schematic reproduction of the plant component, and wherein different virtual images corresponding to the different graphic aspect conditions of the plant component are different one from the other and reproduce schematically real modifications of aspects of the plant component in different operating conditions, wherein the plant simulation program comprises Boolean algorithms including variables, and wherein the variables are defined to represent control signals of different state and operating conditions of the plurality of operating units as well as command signals for commutating and maintaining the different state and operating conditions of the plurality of operating units.

3. A device for checking a software engine for controlling and commanding a plant, the device comprising:

at least a computer having at least a central processing unit and at least a memory for loading and executing programs;

a logical engine for commanding the plant, the logical engine being loadable in the at least a memory for the execution of the logical engine, the logical engine providing control and command signals;

a plurality of operating units configured to actuate, detect, measure, and/or signal, the plurality of operating units being further configured to receive command signals and of transmitting control signals about the operating condition of the plant, the logical engine reading the control signals provided by the plurality of operating units and processing the command signals according to an operation protocol of the plant, wherein a plant simulation software is stored in the memory, wherein the plant simulation software is designed to be controlled and commanded by the logical engine, wherein the plant simulation software is loadable and executable by the at least a computer, wherein the plant software simulation program simulates the plant structure and the operating modes of the plurality of operating units provided in the plant, wherein a plant component is one of the plurality of plant operating units, a predetermined element of the plant, a predetermined area of the plant, or the whole plant, wherein each plant component is univocally associated to a single virtual image, wherein the virtual image is generated by a graphic program loadable and executable by one of the at least a computer, wherein the virtual image is associated to the logical engine, wherein the graphic program is configured to generate several graphic aspect conditions of each plant component, wherein each plant component is associated to a predetermined value of a variable relevant to the operating condition of the plant component and of a command variable for managing the operating state of the plant component, further comprising a first program for simulating a relay operation and a second program for simulating a relay network operation, further comprising graphic programs for representing relays associated to the first program for simulating relay operation and to the second program for simulating relay network operation, wherein an operation of the logical engine is further represented as an equivalent command hardware logic comprising a relay network.

4. A method for checking a software logical engine for controlling and commanding a plant, the method comprising:

using at least a central processing unit and at least a memory for loading and executing programs;

commanding the plant with a logical engine, the logical engine being loadable in said at least a memory for execution of the logical engine, the logical engine providing command and control signals;

receiving command signals and transmitting control signals related to operating conditions of a plurality of operating units situated in the plant, the plurality of operating units being configured to actuate, detect, measure, and/or signal;

reading with the logical engine the control signals provided by the plurality of operating units; and processing the command signals of said plurality of operating units according to an operating protocol of the plant, wherein a plant simulation software that is controlled and commanded by the logical engine is loadable in the at least a memory, wherein the plant simulation software is designed to be executed by the at least a central processing unit, wherein the plant simulation software simulates the plant structure and the operating modes of the plurality of operating units provided in said plant, further comprising means for connecting and interfacing with a validation and certification system that is based on a system different from the logical engine for generating command and control signals, wherein the validation and certification system comprises an additional separate program for generating control and command logical signals generated and memorized in the validation and certification system, wherein the additional program and the plant simulation software each comprise a Boolean equation system, and further comprising the steps of:

comparing the additional program and the plant simulation software by comparing one or more of, the Boolean equation systems of the additional program and of the plant simulation software, or results of simulating tests executed with the additional program and the plant simulation software, and verifying that the additional program and the plant simulation software produce identical results.

5. A method for checking a software logical engine for controlling and commanding a plant, the method comprising:

using at least a central processing unit and at least a memory for loading and executing programs;

commanding the plant with a logical engine, the logical engine being loadable in the at least a memory for execution of the logical engine, the logical engine providing command and control signals;

receiving command signals and transmitting control signals related to operating conditions of a plurality of operating units situated in the plant, the plurality of operating units being configured to actuate, detect, measure, and/or signal;

reading with the logical engine the control signals provided by the plurality of operating units; and processing the command signals of the plurality of operating units according to an operating protocol of the plant, wherein a plant simulation software that is controlled and commanded by the logical engine is loadable in the at least a memory, wherein the plant simulation software is designed to be executed by the at least a central processing unit, wherein the plant simulation software simulates the plant structure and the operating modes of the plurality of operating units provided in the plant, wherein a virtual image of one of the plurality of operating units and of a plant structure is univocally associated to the plant operating units and the plant structural element, wherein the virtual image is generated by a graphic program loadable and executable by the central processing unit, wherein the virtual image is associated to the logical engine;

wherein the graphic program is configured to generate several graphic aspect conditions of one or more of the plurality of operating units, wherein each of the plurality of operating units is associated to a predetermined value of a variable relative to an operating condition of the operating unit and of a variable related to an operating state of the operating unit, wherein the operation of the logical engine is configured to be represented in parallel and in the alternate as a relay network, and wherein a simulating program of relay operation and a simulating program of relay network operation are provided, as well as graphic programs for representing relays associated to the relay simulation program and the graphic program, further comprising the step of displaying the functional behavior of the plant, wherein the display of the functional behavior of the plant is executed according to two modes, the two modes comprising a first mode having a report file that displays values of state variables generated by the plant simulation software, and a second mode having a graphic representation of the operating condition of plurality of operating units, thereby enabling a user to check in detail the plurality of operating units, and therefore the physical operation modes thereof both in an analytic way and in a direct visual way, further comprising the step of setting specific operating conditions of the plant or anomalous situations in the plant, and of checking plant reactions according to several operating environment, further comprising the step of scheduling and configuring images and state and command variables of virtual operating units corresponding to desired operational and state conditions of the plant and a predetermined situation of operation, and the step of executing a visual check of correct operation and an automatic check based on comparing a nominal image and a nominal list of desired state and command variables, and the image and state and command variables really processed during the operation of the logical engine, an error message being sent when the nominal image and the nominal list of the desired state and command variables, are not the same as the image and state and command variables really processed during the operation of the logical engine.

6. The device according to claim 1, further comprising means for displaying an image of plant behavior, wherein the means for displaying are controlled by the logical engine as variable lists univocally associated to the plurality of operating units as report files, and wherein the report files list one or more of the plurality of operating units and the associated state and command variables.

7. The device according to claim 1, wherein the plant simulation program comprises means for setting starting operating conditions of the railway plant and means for simulating anomalous situations of the plurality of operating units, in order to check the reaction of the railway plant to the anomalous situations.

8. The device according to claim 3, wherein each relay in the relay network is simulated by a logical program of Boolean type, wherein the relay network provides relay and commutation commands, wherein single state conditions of the relay and commutation commands are represented by state and command variables, and wherein the graphic programs for representing relays are such as to associate relay graphic aspects that are univocally associated to values of said state and command variables.

9. The device according to claim 3, further comprising means for scheduling and configuring images and state and command variable lists of virtual operating units corresponding to a desired operational and state condition of the plant in conjunction with a predetermined operation situation, wherein means are provided for checking visually a correct operation of the virtual operating units, wherein automatic check means are further provided comparing, and for sending an error message, when one or more of a predetermined nominal image, a nominal table, and a list of desired state and command variables in a virtual model of the plant are not the same as one or more of an image, a table, and state and command variables that are actually processed during the operation of the logical engine.

10. The device according to claim 9, further comprising means for displaying graphically and analytically which operating units have a non-correct condition, and the corresponding state and command variables.

11. The device according to claims 9, wherein the automatic check means are configured to analyze the simulated representation of the relay network, indicating which relays have not been commutated in the correct condition and the corresponding commutation state and command variables.

12. The device according to claim 9, further comprising means for automatically correcting the logical engine according to possible corrections made by a user to the state and commands variables, the state and command variables being manually modified because of a state and command error of one or more of a virtual operating unit and a relay within a corresponding command logical circuit situated in a virtual model of the plant and relay network.

13. The device according to claim 9, wherein modification means provide modification interventions both of alphanumeric type, which modification interventions are executed on report files of state and command variables, and aspect interventions for graphically modifying the aspect of an operating unit and the relay, which aspect interventions correspond to the state of said operating unit and of said relay, and wherein analysis and interpretation means analyze state and command variable values that are manually set to correct any wrong values, analyze the logical engine, and modify the logical engine's code to commute an operating unit and a relay to the correct state condition, when an operating condition occurs due to which the logical engine had previously generated an error signal.

14. The device according to claim 9, further comprising a Boolean simulation program simulating plant operations, further comprising means for associating operating units and plant structural elements so to generate and find areas of the virtual plant and further find the corresponding parts of the logical engine that have plant components that recur in a plurality of plants, and so as to load and reuse in new plants having equal components both the Boolean simulation program, the graphic display program, and parts of the logical engine.

15. The device according to claim 1, further comprising means for connecting and interfacing with a validation and certification system that is based on a system different from the logical engine for generating command and control signals.

16. The device according to claim 15, wherein the validation and certification system comprises a Boolean algorithm checker, wherein the plant simulation program is configured to generate the control and command logical signals during execution of a test step, and wherein validation and certification means are configured to compare the command and control signals generated by the plant simulation program with the command and control signals generated by the Boolean algorithm checker and determine whether the plant simulation program and the Boolean algorithm checker produce identical results.

17. The device according to claims 4, wherein the additional program and the plant simulation software are compared by comparing command and state variables of operating units and relays of the virtual relay network, both numerically and graphically.

18. The device according to claim 17, further comprising means for displaying, in a combined way, graphic images of plant state conditions obtained with both the additional program and the plant simulation software.

19. The device according to claim 18, further comprising means for displaying, by an overlap, plant layout images according to the additional program and the plant simulation software, wherein the overlapping highlights the possible differences between the plant images generated by the additional program and the plant simulation software, and wherein the possible differences are graphically highlighted in a visually relevant way.

20. The device according to claim 4, wherein two different comparison modes with a virtual plant are provided in the logical engine, the two different comparison modes comprising a first comparison mode having a Boolean equation system and a second comparison mode having report files, the result of the first comparison mode being means to identify plant conditions wherein a difference has been noticed and must be subjected to the second comparison mode.

21. The device according to claim 20, wherein a comparison relevant to the plant conditions obtained by the different comparison modes is firstly executed, and wherein the parts of the program are identified, for which the comparison is definable within the Boolean equation system, in order to determine where actions are possible to correct the program.

22. The device according to claim 4, wherein the validation and certification system is configured to analyze, based on diversity, logical programs for simulating one or more of a single operating unit, a plant area, the entire plant, and a logical program for simulating a relay network, and wherein the validation and certification system is configured to extend the analyzing, based on the diversity, even to programs for graphically representing one or more of an operating unit and a relay.

23. The device according to claim 1, further comprising a network interface, wherein the device comprises a non-vital node of the railway plant, and wherein the device further comprises means for quickly modifying and for virtually validating the control and command logical program.

24. The device according to claim 23, wherein the device is configured to operate as a diagnostic and supervisory tool for proper operation of the railway plant, and wherein the device reproduces a simulated plant simulating the actual railway plant in a desired state condition, the device further comprising a comparator between an actual state condition of the railway plant and a state condition of the simulated plant.

25. The device according to claim 23, wherein the device is configured to simulate emergency interventions before applications to the railway plant, and wherein in an emergency situation it is possible the device is further configured to simulate several intervention and command possibilities to be executed on the railway plant, thereby indicating an optimal choice among the several intervention and command possibilities.

26. The device according to claim 1, further comprising tools for executing simulating functions with a user interface as used by a desired computer operating system, thereby providing an operator with operating windows having function buttons, quick choice menus and other functionalities typical of said user interface, in addition to the use of a pointing system, selection and command input systems, and a keyboard to input numerical data, the operating windows providing graphic images of operating units, relays, and other parts of the railway plant.

27. The device according to claim 1, further comprising means for setting specific operating conditions and anomalous situations in the railway plant, and further for checking the changes in operating conditions in the railway plant according to different operating environments.

28. The device according to claim 27, wherein manually setting means are provided to an operator of the device, wherein the manually setting means are configured to impose, at the starting of a cycle for executing control and command signals, specific state conditions to the plurality of operating units, wherein conditions are provided that cause one or more of the plurality of operating units to operate anomalously by operating incorrectly or by failing to operate.

29. The method according to claim 2, wherein an image of a simulated behavior of the railway plant under the control of the logical engine is displayed as variables list univocally associated to the plurality of operating units as report files, and wherein the plurality of operating units and the state and command variables associated with the plurality of operating units are listed.

30. The method according to claim 2, further comprising the step of enabling a user to set operating conditions of the railway plant at start-up, and wherein the user is further enabled to set specific conditions of the plurality of operating units, thereby verifying a reaction of the operating plant to the set conditions.

31. The method according to claim 2, wherein the operation of the logical engine is configured to be represented in parallel and in the alternate as a relay network, and wherein a simulating program of relay operation and a simulating program of relay network operation are provided, as well as graphic programs representing relays univocally associated to the relay simulation program and the graphic program.

32. The method according to claim 31, wherein the railways plant comprises relays that are configured to receive commutation commands, wherein each relay is simulated by a Boolean logical program, wherein individual state conditions of the relays and of the commutation commands are represented by state and command variables, and wherein graphic programs associate different graphic aspects of the relays with values of said state and command variables.

33. The method according to claim 31, further comprising the step of displaying the functional behavior of the railway plant, wherein the display of the functional behavior of the railway plant is executed according to two modes, the two modes comprising a first mode having a report file that displays values of state variables generated by the plant simulation software, and a second mode having a graphic representation of the operating condition of plurality of operating units, thereby enabling a user to check in detail the plurality of operating units, and the physical operation modes thereof both in an analytic way and in a visual way.

34. The method according to claim 33, further comprising the step of setting specific operating conditions of the railway plant, anomalous situations in the railway plant, and plant reactions according to several operating environment.

35. The method according to claim 34, wherein the step of setting is implemented at a specific step of the plant simulation program, wherein a suitable scheduling event conditions is provided wherein one or more of the plurality of operating units operate anomalously by operating incorrectly or by failing to operate.

36. The method according to claim 5, wherein the automatic check is configured to provide a graphic and analytical display of the operating unit that has assumed a non-correct condition, and to provide the corresponding state and command variables, and the graphic and analytic display of state variables of the simulated relay network.

37. The method according to claim 5, further comprising the step of providing automatic tools for correcting the logical engine according to possible corrections made by the user to the state and command variables, the state and command variables being manually modified because of a state and command error of one or more of a virtual operating unit and of a relay in the command logic within a virtual model of the relay network.

38. The method according to claim 37, wherein modification interventions are executed both of alphanumeric type on report files of state and command variables, and of graphic type on the operating unit and the relay, the graphic interventions corresponding to the state of said operating unit and said relay, said alphanumeric and graphic interventions being performed by a correction program that analyzes state and command variables values that are manually set to correct undesired values, and that further analyzes the logical engine and modifies the logical engine's code to commute the operating unit and the relay to the desired state conditions when an operating condition occurs due to which the logical engine had generated an error.

39. The method according to claim 5, further comprising the step of providing a Boolean simulation program simulating plant operations, wherein the read in of areas of the simulated plant operations and the corresponding parts of the logical engine comprise plant structures that recur in several plants, so to be able to load and reuse both the Boolean simulation program, and a related graphic display program, and parts of the logical engine in new plants having equal operations.

40. The method according to claim 5, further comprising the step of providing an alternative and a parallel execution of a check of the logical engine during a test step with the plant simulation software, wherein the alternative and the parallel execution comprise using a Boolean checker that employs a control and command logical program generated with diversity principles and that compares the logical engine during the test step with the command and control logical program generated with diversity principles.

41. The method according to claim 40, further comprising the step of providing an additional program for generating the control and command instructions related to the test step, wherein the additional program operates according to a code different from that of the plant simulation software, wherein the additional program and the plant simulation software each comprise a Boolean equation system, and wherein the additional program and the plant simulation software are compared by the Boolean checker to identify difference in the Boolean equation systems.

42. The method according to claim 41, wherein the control and command logical program is subjected to the test step by using a virtual plant, and wherein the results obtained by the control and command logical program and the plant simulation software are compared.

43. The method according to claim 42, further comprising the capability of providing a display, both in the shape of comparative tables of variables and in the shape of graphic comparisons, of operational differences between the control and command logical program and the plant simulation software, the operational differences being generated according to diversity criterions, and of operational differences between relay networks that correspond to the two Boolean equation systems, the variables and the graphic comparisons being highlighted which are different both within the comparative tables and within the graphic comparisons.

44. The method according to claim 43, further comprising the step of providing an overlap of graphic images of the plant state conditions obtained by the control and command logical program and by the plant simulation software, the differences in the overlap of the graphic images of the plant state condition being graphically highlighted.

45. The method according to claim 44, wherein the two modes for displaying the functional behavior of the plant are executed in alternative and in sequence, wherein the control and command logical program and the plant simulation software are compared at the Boolean equation system level and at the result of the test e step, and wherein the sequence order of the two modes are modifyable.

46. The method according to claim 45, wherein the control and command logical program and the plant simulation software are compared with comparison steps comprising:

executing a first comparison in relation to plant conditions obtained by the control and command logical program and the plant simulation software;

identifying, in the basis of the first comparison, on which parts of the control and command logical program and of the plant simulation software subsequent comparison actions are limitable;

executing a second comparison in relation to the Boolean equations of the control and command logical program and of the plant simulation software, the second comparison being limited to the equations that caused the functional divergences that were found in the first comparison; and executing the possible corrective actions thereof and error detections on the Boolean equations identified as responsible for the divergent behavior of the plant.

47. The method according to claim 46, wherein the first and second comparisons are executed with a program generated according to a different code, wherein the capability is provided of executing additional comparison steps related to the simulation and the graphic representation of operating units, the plant structure, and the relays and the relay network.

48. The method according to claim 46, further comprising the step of certifying the plant simulation software with parallel means, the parallel means comprising an additional independent program that executes in parallel the test of the Booleans equation system comprised in the plant simulation software, thereby executing a double test by performing a plant simulation, the behavior of the simulated plant obtained with the plant simulation software in the two separated and parallel test steps being compared, and one or more of alert and error files being generated in case of a discrepancy.

49. The method according to claim 41, further comprising the step of creating an operating connection to remote operating units and remote networks, so to be able to command test functions from a remote workstation and to execute alternative functions as functions of a non vital node of the plant.

50. The method according to claim 49, further comprising the step of updating the plant simulation software and the test steps in case of a structural modification of the plant.

51. The method according to claim 49, further comprising the step supervising and diagnosing the correct operation of the plant by executing a comparison between the state of the railway plant and the state conditions of the simulated plant.

52. The method according to claim 49, further comprising the step of simulating a virtual emergency for intervention and command on the railway plant, thereby implementing on the railway plant only the choice that offers the optimal solution under an emergency condition among the possible choices.

53. The method according to claim 2, further comprising the step of executing simulation functions with an user interface of an operating system displaying operating windows with function buttons, quick choice menus and other functionalities within the operating windows, further comprising the step of providing pointing means, and a keyboard to input numerical, alphanumerical data, and numerical and alphanumerical commands, thereby creating and modifying graphic images of operating units, relays, and other parts of the railway plant.

* * * * *